US008789341B2

(12) United States Patent
Shepard

(10) Patent No.: US 8,789,341 B2
(45) Date of Patent: Jul. 29, 2014

(54) HYBRID TOP CHORD BEARING FRAMING SYSTEM

(71) Applicant: Mark Shepard, Sugar Land, TX (US)

(72) Inventor: Mark Shepard, Sugar Land, TX (US)

( * ) Notice: Subject to any disclaimer, the term of this patent is extended or adjusted under 35 U.S.C. 154(b) by 0 days.

(21) Appl. No.: 13/887,510

(22) Filed: May 6, 2013

(65) Prior Publication Data

US 2013/0239515 A1 Sep. 19, 2013

Related U.S. Application Data

(62) Division of application No. 12/687,615, filed on Jan. 14, 2010, now Pat. No. 8,448,406.

(60) Provisional application No. 61/145,407, filed on Jan. 16, 2009.

(51) Int. Cl.

| | |
|---|---|
| ***E04B 1/00*** | (2006.01) |
| ***E04H 12/00*** | (2006.01) |
| ***E04B 1/10*** | (2006.01) |
| *E04G 1/15* | (2006.01) |

(52) U.S. Cl.

CPC .. *E04B 1/10* (2013.01); *E04G 1/151* (2013.01)
USPC ..... 52/745.2; 52/262; 52/283; 52/638; 52/652.1; 52/653.1

(58) Field of Classification Search

CPC ..... E04B 1/02; E04B 1/10; E04B 1/18; E04B 1/19; E04B 1/26; E04B 1/2604; E04C 3/02; E04C 3/12
USPC ..... 52/262, 264, 265, 745.05, 261, 283, 52/637, 638, 652.1, 653.1, 745.2, 745.21
See application file for complete search history.

(56) References Cited

U.S. PATENT DOCUMENTS

| | | | | |
|---|---|---|---|---|
| 5,531,054 | A * | 7/1996 | Ramirez | 52/741.1 |
| 6,240,695 | B1 * | 6/2001 | Karalic et al. | 52/690 |
| 6,688,058 | B2 * | 2/2004 | Espinosa | 52/293.3 |
| 6,931,804 | B2 * | 8/2005 | Trarup et al. | 52/295 |
| 7,665,257 | B2 * | 2/2010 | Posey | 52/223.13 |
| 2005/0284057 | A1 * | 12/2005 | Commins | 52/295 |
| 2009/0188193 | A1 * | 7/2009 | Studebaker et al. | 52/321 |

* cited by examiner

*Primary Examiner* — William Gilbert
(74) *Attorney, Agent, or Firm* — Shook, Hardy & Bacon L.L.P.

(57) ABSTRACT

A method and system is provided for constructing a multi-level structure using a hybrid top chord bearing floor framing system. The method and system may include a top chord bearing floor truss positioned on a first frame structure. The top chord of the truss may include a load-bearing interface with a top surface and a bottom surface. The truss may be wholly supported by the load-bearing interface of the top chord. The method and system may further include a second frame structure on the top surface of the truss. The first frame structure may be secured to the second frame structure via a fastener that extends through both the second bottom load bearing member and load-bearing interface of the truss into the first top load bearing member of the first frame structure.

10 Claims, 29 Drawing Sheets

HYBRID TOP CHORD BEARING FRAMING SYSTEM

PRIORITY CLAIM

This application is a divisional application of U.S. patent application Ser. No. 12/687,615, filed Jan. 14, 2010.

BACKGROUND

One of the first phases of a construction project is the framing stage. It is during this phase that the basic framework for the structure is created. One key component in a framing system is a truss. A truss is generally defined as a prebuilt component that functions as a structural support member for the housing or building. Because there are a number of different types of trusses and a number of different applications for trusses, the truss system implemented in a framing system can have a significant impact on material cost, installation time, and inspection time.

SUMMARY

Embodiments of the invention are defined by the claims below, not this summary. A high-level overview of various aspects of the invention are provided here for that reason, to provide an overview of the disclosure, and to introduce a selection of concepts that are further described in the detailed-description section below. This summary is not intended to identify key features or essential features of the claimed subject matter, nor is it intended to be used as an aid in isolation to determine the scope of the claimed subject matter.

Embodiments of the present invention relate to a hybrid top chord bearing floor framing system. As illustrated in the figures that follow, embodiments of the present invention may be utilized and implemented in a number of different framing and construction designs and configurations. One skilled in the art would appreciate that embodiments of the hybrid top chord bearing floor framing system offer a number of structural design benefits, architectural benefits, framing benefits, sheetrock benefits, fire protection benefits, and financial benefits, as discussed in more detail below.

In a first aspect, a method is provided for constructing a multilevel structure using a hybrid top chord bearing floor framing system. The method may be implemented by orienting a first frame structure to support a truss. The first frame structure may include a first bottom load bearing member and first top load bearing members. In addition, the first frame structure may be supported by a foundation structure and include a plurality of vertical-members configured to transfer a load from the first top load bearing members to the first bottom load bearing member.

The method may further include positioning a truss on the first top load bearing members. The truss may include a top chord having a load-bearing interface that includes a top surface and a bottom surface. The truss may be wholly supported by the load-bearing interface of the top chord via the bottom surface connected to the first top load bearing members.

In addition, the method may include positioning a second frame structure on the top surface of the floor sheathing which is on the top surface of the truss. The second frame structure having a second bottom load bearing member and a plurality of vertical-members configured to transfer a load from the second top load bearing members of the second frame structure to the second bottom load bearing members. The second frame structure may be secured to the first frame structure via a fastener that extends through both the second bottom load bearing member, the floor sheathing, the load-bearing interface of the truss and blocking between the truss into the first top load bearing members of the first frame structure.

BRIEF DESCRIPTION OF THE SEVERAL VIEWS OF THE DRAWINGS

Illustrative embodiments of the present invention are described in detail below with reference to the attached drawing figures, and wherein.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Figure 1A:
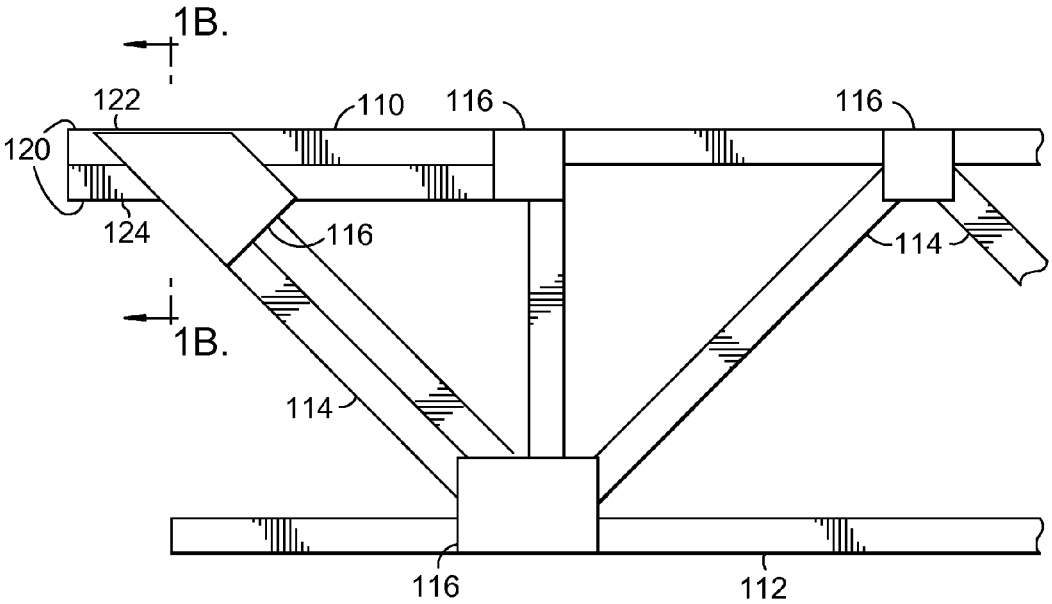
FIG. 1A is an exemplary view of a hybrid top chord bearing floor truss, in accordance with an embodiment of the present invention.

Turning now to FIG. 1A, an illustrative hybrid top chord bearing floor truss is provided and referenced generally by the numeral 100. Hybrid top chord bearing floor truss 100 includes top chord 110 and bottom chord 112 and plurality of webs 114. Top chord 110, bottom chord 112, and webs 114 are connected together and stabilized via connector plates 116. In general, a truss provides structural support by employing one or more triangles to distribute the weight. In the case of top chord bearing floor trusses, the truss is loaded on top chord 110. That is, bottom chord 112 is not directly loaded or fastened to other support structures. Specifically, hybrid top chord bearing floor truss 100 may be fastened to a support member via load-bearing interface 120.

Figure 1B:
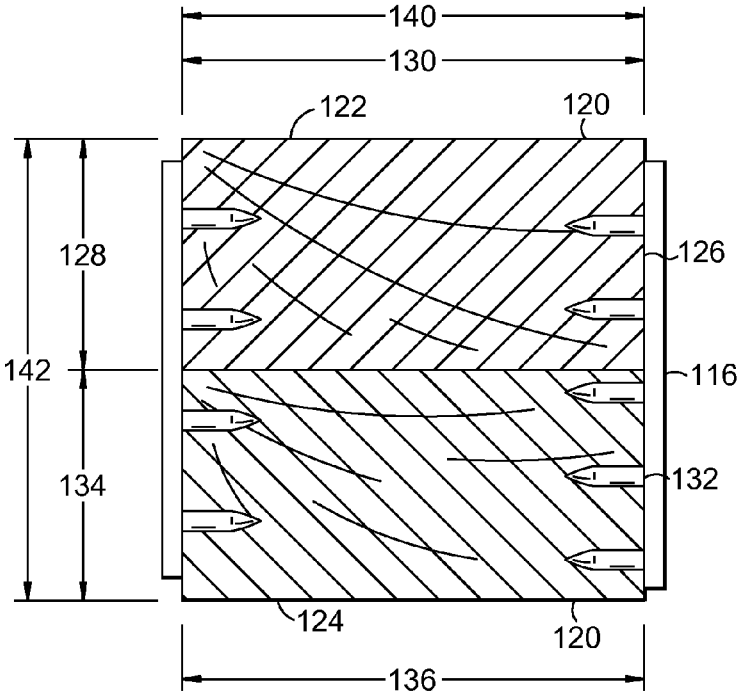
FIG. 1B is a cross-sectional view of an exemplary load bearing interface of a hybrid top chord bearing floor truss when viewed from the perspective of 1B-1B of FIG. 1A, in accordance with an embodiment of the present invention.

Load bearing interface 120 includes a top surface 122 and a bottom surface 124. FIG. 1B is a cross-sectional view of load bearing interface 120. In one embodiment of the present invention, load bearing interface 120 includes two plates or members. The first member 126 has a height 128 and a width 130. Likewise, second member 132 has a height 134 and a width 136. Members 126 and 132 may include any cross-sectional dimensions. For example, in one embodiment of the present invention, each member 126 and 132 includes a "2×4" fastened together via connector plates 116. The height 128, 134 of a 2×4 is typically 1.5 inches and the width 130, 136 of a 2×4 is typically 3.5 inches. Thus, in this embodiment, the total dimensions 140, 142 of load bearing interface 120 is less than 4 inches wide by 3 inches tall. As will be discussed in more detail below, this provides a low-profile load path through load bearing interface 120 of hybrid top chord bearing floor truss 100. This low profile load path provides structural benefits, reduces the required materials and hardware, and reduces the installation time.

Figure 2A:
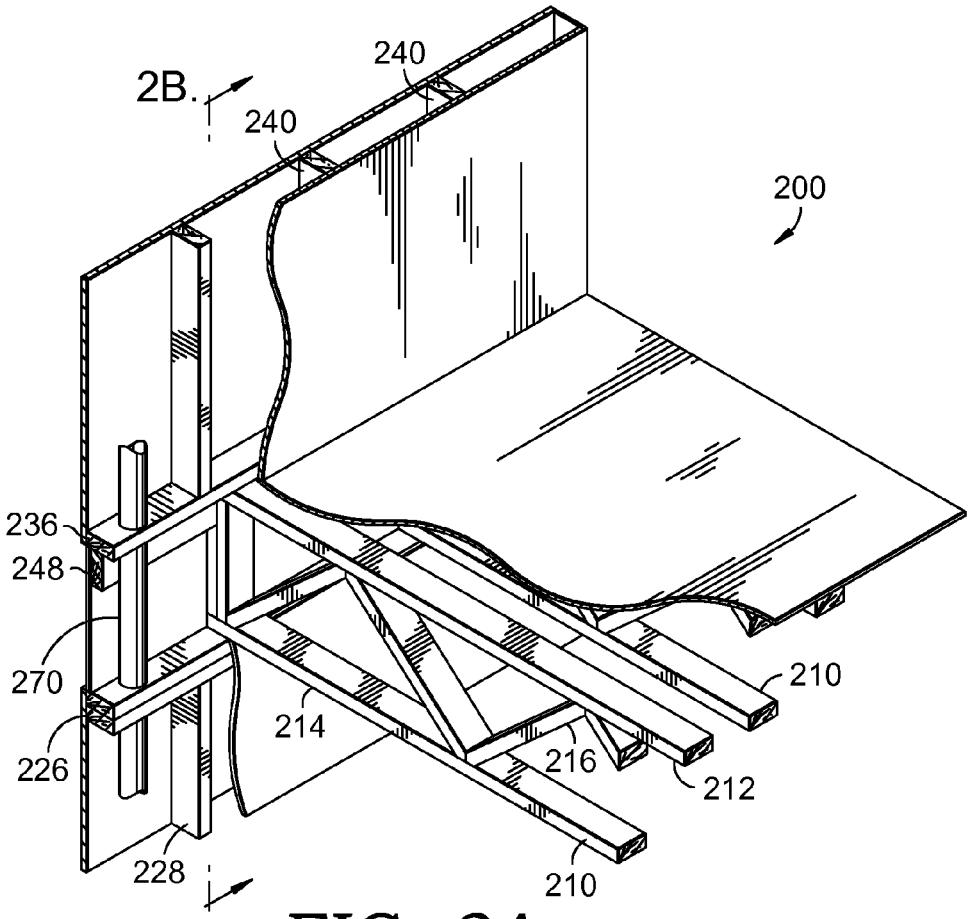
FIG. 2A. (PRIOR ART)
FIG. 2A is a perspective view of an interface between a bottom chord bearing floor truss and an exterior wall, the figure illustrates the prior art.
Figure 2B:
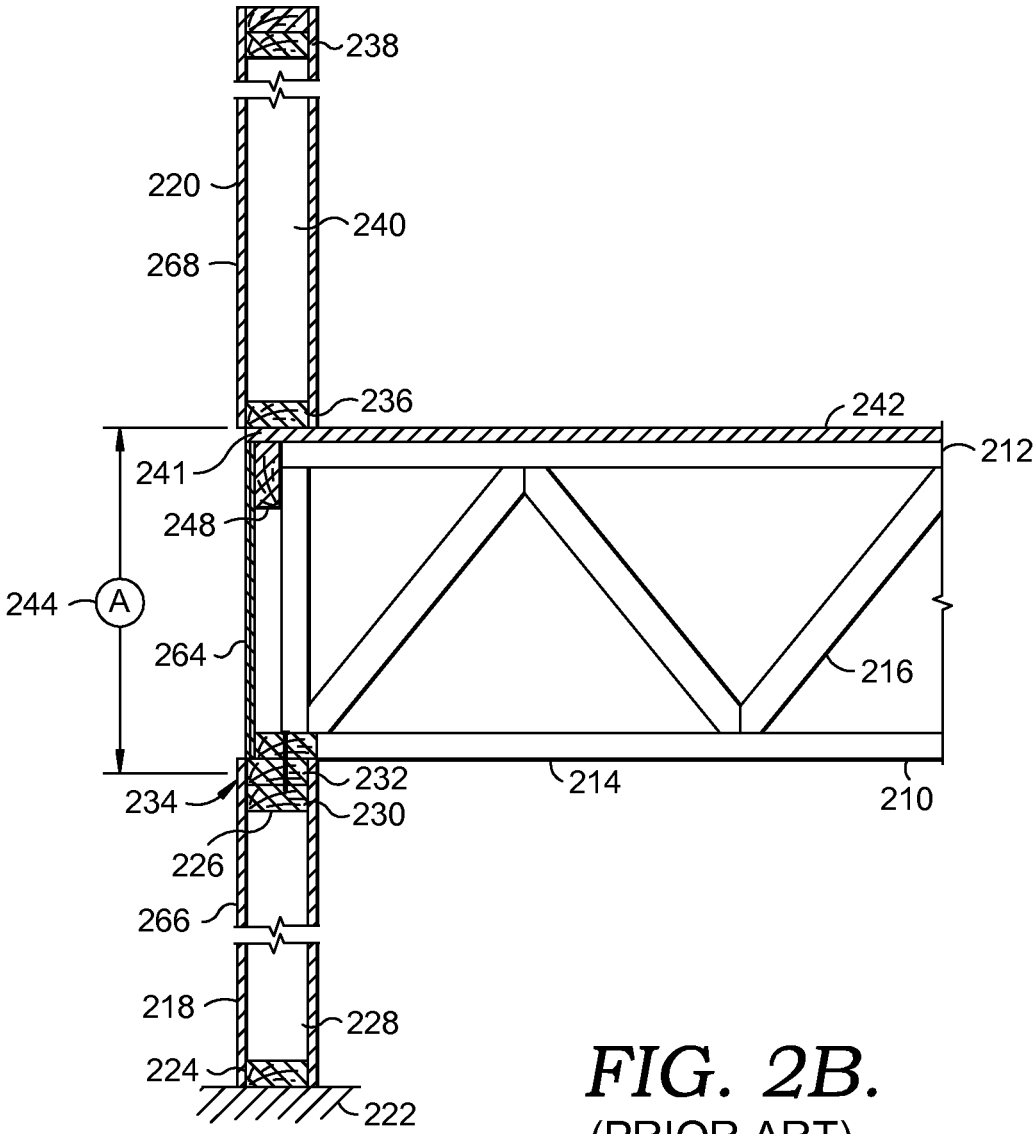
FIG. 2B. (PRIOR ART)
FIG. 2B is a cross-sectional view of an interface between a bottom chord bearing floor truss and an exterior wall when viewed from the perspective of 2B-2B of FIG. 2A, the figure illustrates the prior art.

FIG. 2A is a perspective view of the prior art interface 200 between a bottom chord bearing floor truss and an exterior wall. In this system, bottom chord bearing floor truss 210 includes a top chord 212, bottom chord 214, and a plurality of webs 216. Also there is a continuous band 248. Unlike the top chord bearing floor truss, bottom chord bearing floor truss 210 transfers a load at both the top chord 212 and the bottom chord 214. FIG. 2B illustrates a cross-sectional view of the bottom chord bearing system 200 when viewed from perspective 2B-2B of FIG. 2A. Generally speaking, bottom chord bearing framing systems include a bottom chord bearing floor truss 210, a continuous band 248, a first frame structure 218, a second frame structure 220 and floor sheathing 242. First frame structure may be generally supported by a foundation structure 222 and includes a bottom load bearing member 224 and a top load bearing member 226. Bottom load bearing member 224 may be connected to top load bearing members via a plurality of vertical-members 228 or studs as seen in FIG. 2A. Vertical-members 228 or studs are configured to transfer a load from top load bearing members 226 to bottom load bearing member 224. In sum, top load bearing members 226, bottom load bearing member 224, and a plurality of vertical-members 228 or studs form a first frame structure 218 that may be oriented to support bottom load bearing floor truss 210. FIG. 2B further illustrates that top load bearing member 226 includes two plates or members 230, 232. Plates 230, 232 support bottom load bearing floor truss 210 at a first connection point 234.

In a multilevel structure, a second frame structure 220 may also be supported by bottom chord bearing floor truss 210. FIGS. 2A and 2B illustrate such a second structure 220. Second frame structure 220 includes a bottom load bearing member 236 and top load bearing members 238. Loads from the top load bearing members 238 may be transferred to the bottom load bearing member 236 via a plurality of vertical-members 240 or studs. In this configuration, second frame structure 220 is supported by the top chord 212 of bottom chord bearing floor truss 210 and continuous band 248 at a second connection point 241. In addition, floor sheathing 242 may be placed in between second frame structure 220 and bottom chord bearing floor truss 210.

Of particular interest in this structural framing system is dimension 244 labeled "A." This dimension is determined by the distance between top chord 212 and bottom chord 214 of bottom load bearing floor truss 210. For instance, it is not uncommon for dimension 244 to be 12 inches or greater. Likewise, the distance between connection points 234 and 241 will also be 12 inches or greater. This distance can impact the mechanical integrity of a multilevel structure, as well as a number of construction issues. For instance, a "domino effect" can result when the distance between connection points 234 and 241 is 12 inches or greater, as is present with a bottom chord bearing floor truss. This "domino effect" results in an inherently weaker structure because the bottom chord bearing floor truss tends to "tip" "roll" or "domino" over.

Figure 2C:
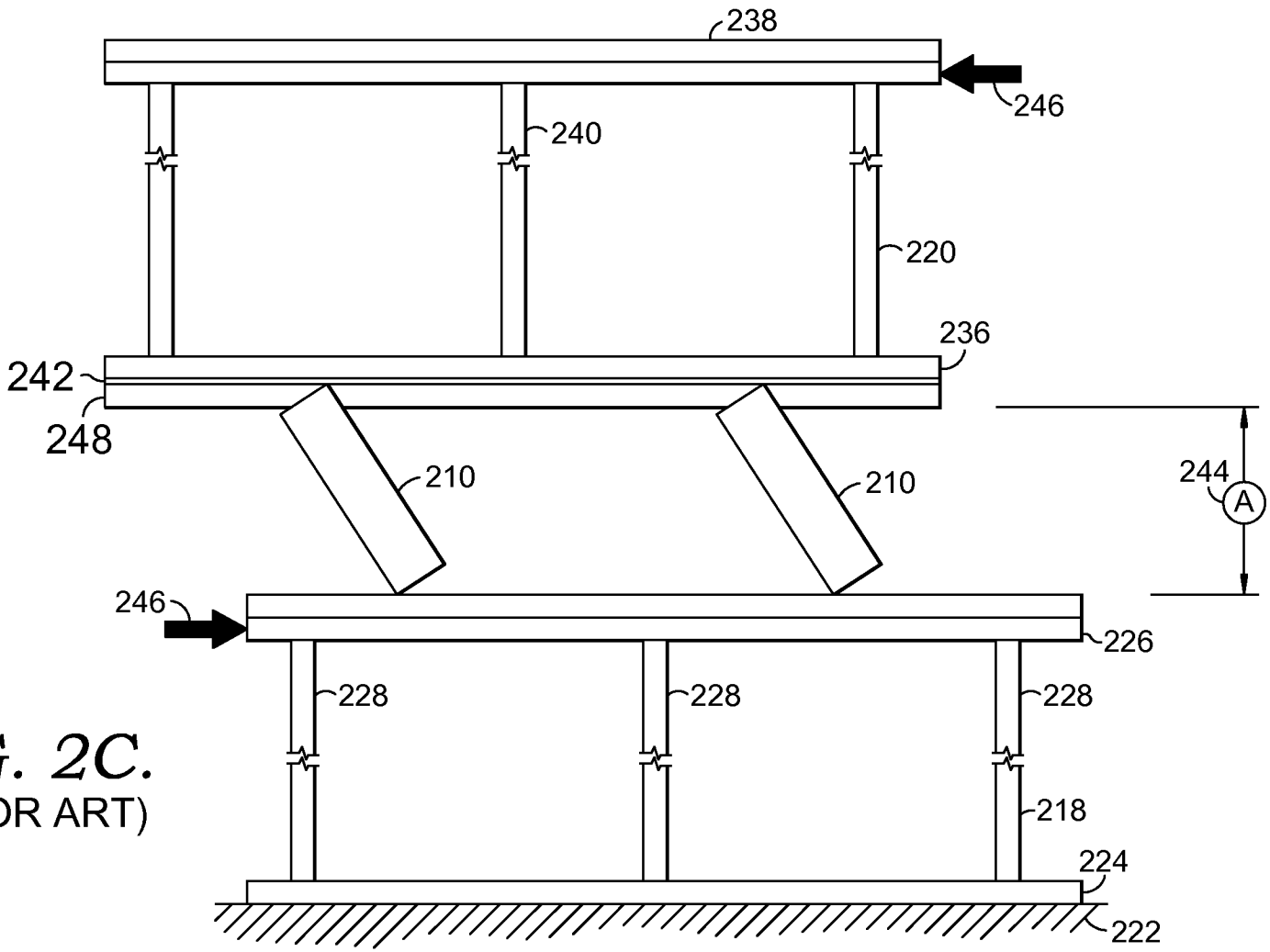
FIG. 2C. (PRIOR ART)
FIG. 2C is a front view of an interface between a bottom chord bearing floor truss and an exterior wall, the figure illustrates the prior art.

FIG. 2C is a front view of a bottom chord bearing floor truss interface for a multilevel structure. Specifically, FIG. 2 illustrates the domino effect that may result when a greater distance 244 is between first frame structure 218 and second frame structure 220. For example, when a cross-load 246 is applied to the multilevel structure, second frame structure 220 may be displaced in an opposite direction from first frame structure 218 tending to cause the truss 210 to domino over as is illustrated. Thus, when distance 244 is minimized, the domino effect is mitigated. However, as discussed, bottom chord bearing floor trusses do not allow for a reduced distance 244.

The use of a bottom chord bearing floor truss also creates potential joint problems. Specifically, joints 234 and 241 are spaced a significant distance apart when a bottom chord bearing floor truss is used. This significant distance can create problems for exterior surfaces that span the two joints when the multilevel structure expands or contracts. Such exterior surfaces include stucco or other surfaces bonded to the exterior walls that depend on relative displacement of the frame structure 218, 220. In other words, distance 244 creates two shrinkage problems or joint problems when the relative wood members begin to shrink or retract from one another in relation to the exterior bonded wall. This shrinkage adds additional loads on the walls, which can cause them to crack. Thus, as will be discussed in more detail below, embodiments of the present invention mitigate shrinkage problems and the domino effect by minimizing distance 244.

Figure 3A:
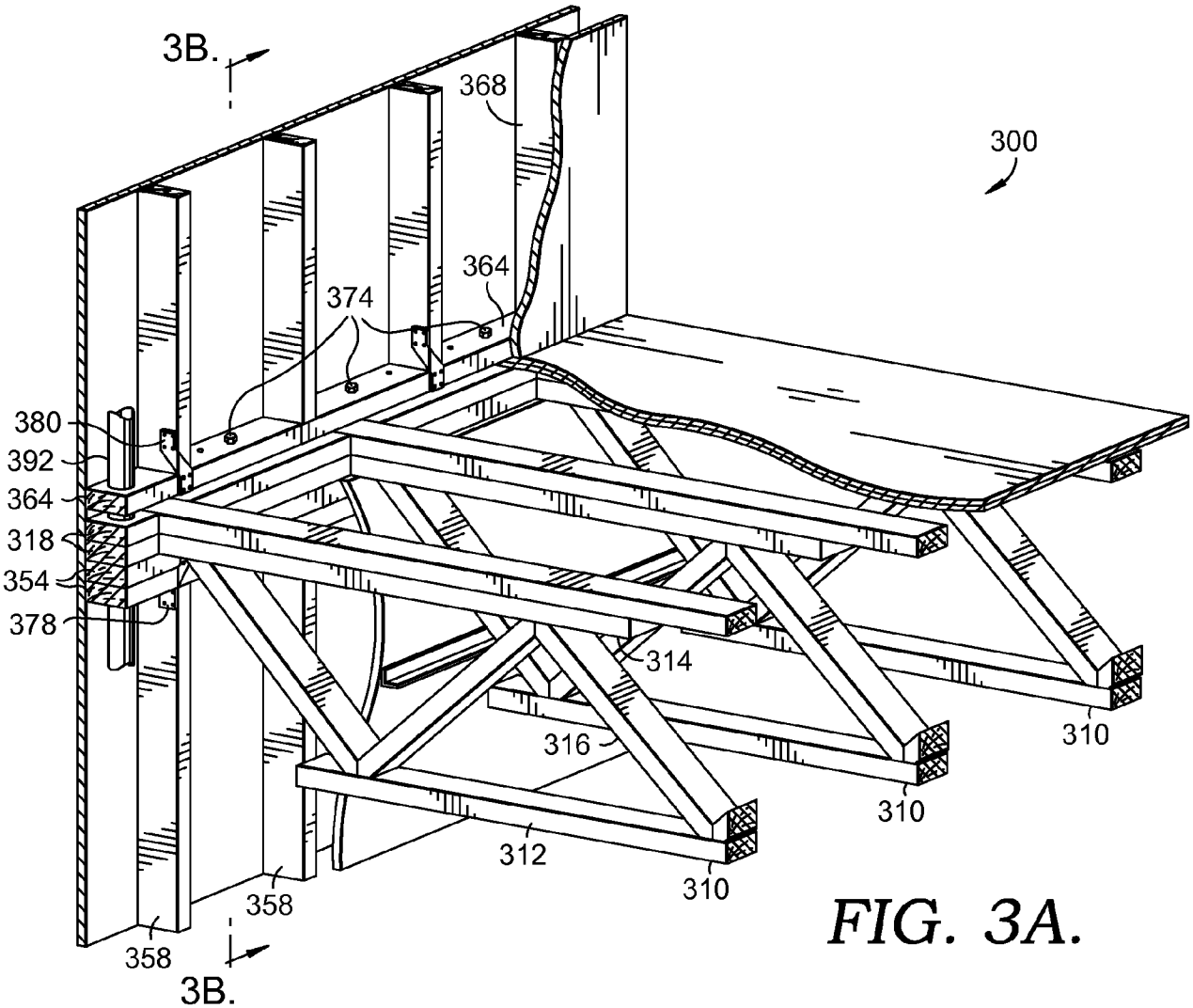
FIG. 3A is a perspective view of an interface between an exemplary hybrid top chord bearing floor truss and an exterior wall, in accordance with an embodiment of the present invention.
Figure 3B:
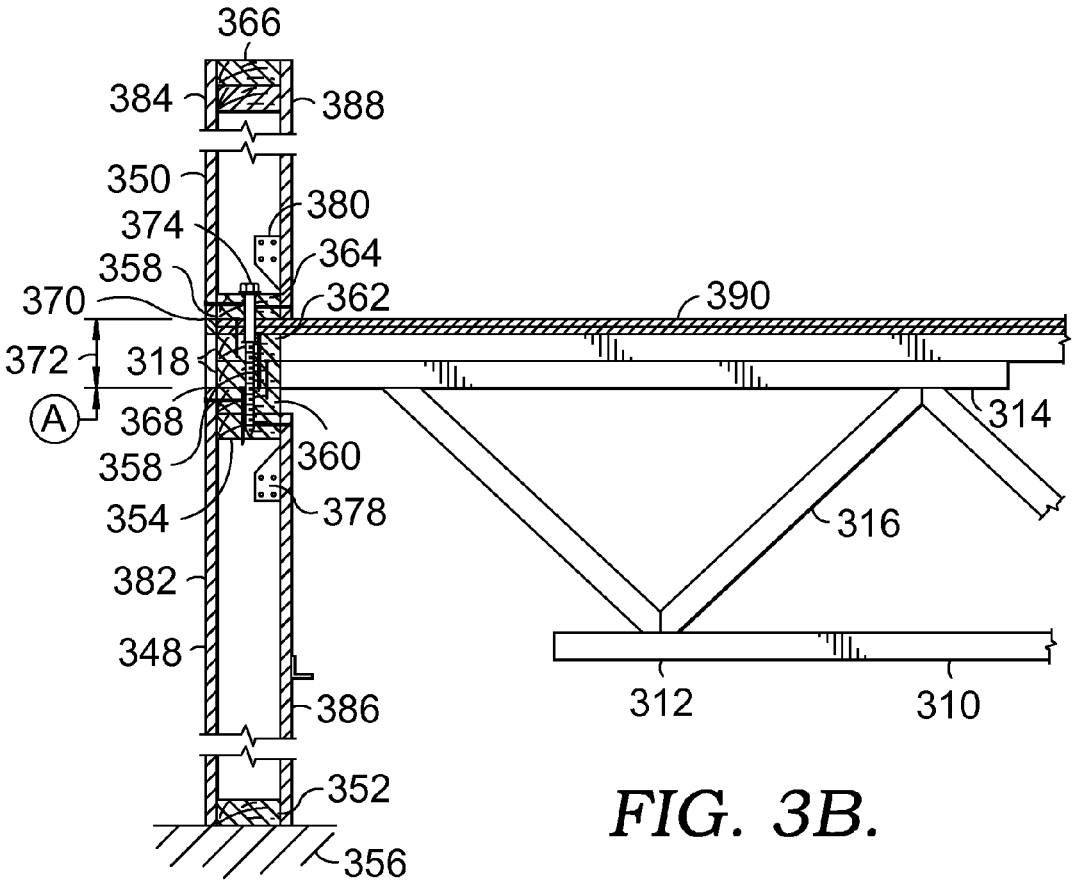
FIG. 3B is a cross-sectional view of an interface between an exemplary hybrid top chord bearing floor truss and an exterior wall when viewed from the perspective of 3B-3B of FIG. 3A, in accordance with an embodiment of the present invention.
Figure 3C:
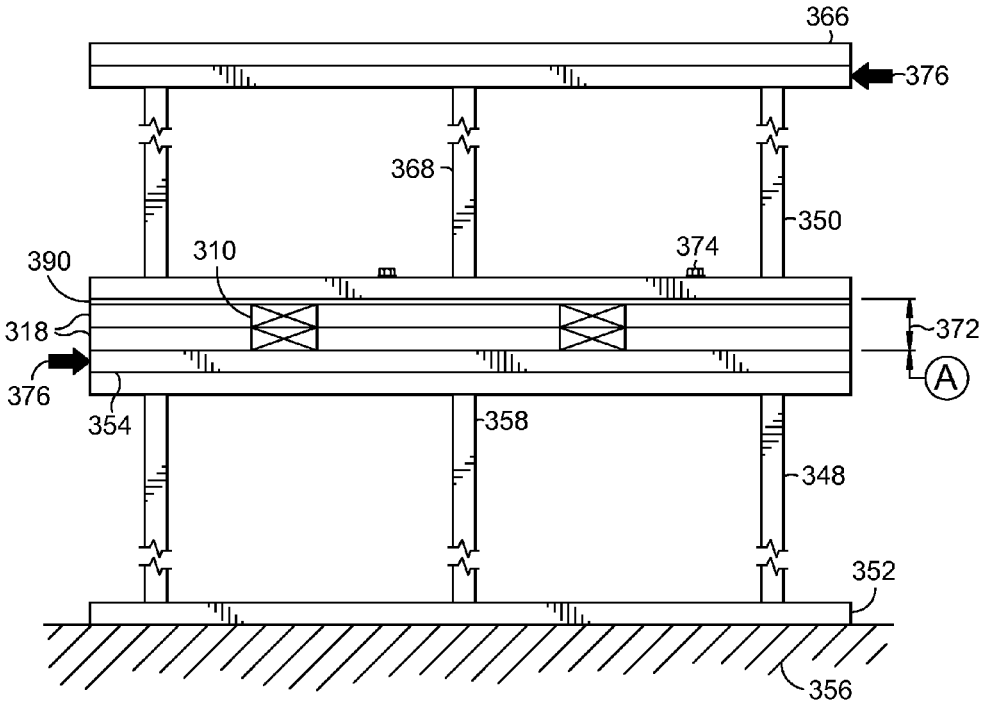
FIG. 3C is a front view of an interface between an exemplary hybrid top chord bearing floor truss and an exterior wall, in accordance with an embodiment of the present invention.

Turning now to FIGS. 3A, 3B, and 3C an embodiment of the hybrid top chord bearing floor system is illustrated and generally referenced by numeral 300. Specifically, FIG. 3A is a perspective view of an interface between an exemplary hybrid top chord bearing floor truss and an exterior wall. FIG. 3B is a cross-sectional view of an interface between an exemplary hybrid top chord bearing floor truss and an exterior wall when viewed from the perspective of 3B-3B of FIG. 3A. The figures illustrate the implementation of a hybrid top chord bearing floor framing system using top chord bearing floor trusses 310, which were also depicted in FIG. 1A and blocking 318 between top chord bearing floor trusses 310.

Trusses 310 may include a bottom chord 312, a top chord 314, and a plurality of webs 316 configured in a triangular fashion. The figure illustrates a top chord bearing floor truss supported by a first frame structure 348, which further supports a second frame structure 350. The first frame structure includes a bottom load bearing member or plate 352 and top load bearing members or top plate 354. The first frame structure is supported by a foundation structure 356. Additionally, a plurality of vertical-members or studs 358 are configured to transfer a load from first top load bearing members 354 to the first bottom load bearing member 352.

As discussed with regard to FIG. 3B, top chord bearing floor truss 310 includes a load bearing interface 359. The bottom surface 360 of the top chord bearing floor truss 310 is supported by first top load bearing members 354. The top surface 362 of the top chord bearing floor truss 310 supports second frame structure 350. In addition there is blocking 318 between top chord bearing floor trusses 310. Similar to first frame structure 348, second frame structure 350 includes a bottom load bearing member 364 that is connected to top load bearing members 366 via a plurality of vertical-members or studs 368. The connection point between the first frame structure 348 and truss 310 and blocking 318 is illustrated as 368. Likewise, the connection point between the second frame structure 350 and truss 310 and blocking 318 is illustrated as 370. Again, the relative distance between connection point 368 and 370 is listed as variable "A" and referenced as numeral 372. As illustrated, embodiments of the present invention minimize the distance between connection points 368 and 370.

In addition, embodiments of the present invention may implement a fastener 374 to further secure second frame structure 350 and first frame structure 348. Fastener 374 may extend through bottom load bearing member 364, blocking 318 and load bearing interface 359 into top load bearing members 354 of first frame structure 348. Fastener 374 may include a threaded portion to further provide mechanical strength to the jointed connection. Thus, embodiments of the present invention not only minimize distance 372 between the connections 368 and 370, but also provides fastener 374 to further secure the two frame structures together. In one embodiment, fastener 374 is less than 8.5 inches long.

Turning now to FIG. 3C, a front view of an interface between an exemplary hybrid top chord bearing floor truss and an exterior wall is depicted in the figure. The figure illustrates that when distance 372 is minimized, the domino effect is eliminated because connection points 368 and 370 are closer together. For example, when a cross-load 376 is applied to the multilevel structure, second frame structure 350 does not tend to domino over because the hybrid top chord floor framing system minimizes distance 372.

In addition, the hybrid top chord bearing floor framing system minimizes problems associated with shrinkage and the cracking that occurs when exterior surfaces are bonded to the framing system. Specifically, comparing FIG. 2C to FIG. 3C, one of ordinary skill in the art would appreciate that the distance between the respective connection points is significantly reduced when embodiments of the hybrid top chord bearing floor framing system are implemented. That is, shrinkage now occurs over a much smaller distance 372 versus the larger distance 244, illustrated in FIG. 2B. Moreover, fastener 374 is used to preload the joint and hold the respective parts tightly together. This also prevents separation at connection points 368 and 370. In other words, fastener 374 is a single member that extends through a portion of the second frame structure 350, through blocking 318, and into first frame structure 348. In contrast, the prior art does not include a single fastener that extends all the way through these parts as illustrated by FIG. 2B. Instead, nails are used to secure each part individually, and therefore cannot account for shrinkage in relative parts that are not fastened directly together.

Additionally, embodiments of the present invention may include a first clip 378 and a second clip 380 as illustrated in FIG. 3A and FIG. 3B. Clips 378 and 380 may be used to connect at least one vertical-member 358 of first frame structure 348 to top load bearing members 354, and at least one vertical-member 368 of second frame structure 350 to bottom load bearing member 364. These connections provide resistance against uplift forces that tend to separate the second frame structure from the first frame structure and truss 310. It is also important to note that clips 378, 380 and fastener 374 may replace exterior straps. This allows all of the hardware to be installed within the structure and takes the installation of connecters outside of the critical path.

In addition to reducing the distance between connection points 370 and 368, embodiments of the present invention provide additional time and cost saving benefits. Specifically, FIG. 2B illustrates that a wood panel 264 is required to bridge the gap between connection points 241 and 234. That is, exterior wall 266, attached to first frame structure 218, extends up to the bottom chord 214 of truss 210. Likewise, exterior wall 268, attached to second frame structure 220, extends to top chord 212 of truss 210. This requires an additional piece of material 264, which in this case is a wood structural panel, to bridge this gap. In contrast, exterior wall sheathing 382 attached to first frame structure 348 extends all the way up to the bottom surface 360 of truss 310. Likewise, exterior wall 384 attached to second frame structure 350 can extend all the way to or in close proximity of top surface 362 of truss 310. Thus, the wood structural panel 264 illustrated in FIG. 2B is completely eliminated, saving both material and installation cost.

In addition, the elimination of the wood panel and trusses simplifies computer modeling when conducting load path analysis. Specifically, load path analysis may be used to limit or eliminate: (1) the use of plywood shear walls; (2) the use of drag trusses and shear panels in the floor system, and the special nailing associated with these components; and (3) the weak pivot point links at floors that are present in bottom chord truss bearing systems (i.e., domino effect).

As background, wood structural panel 264 may be required in the bottom chord bearing floor truss to prevent drafts through the truss section as required by building codes. Referring to FIG. 3B, wood structural panel 264 is not required because there is not a draft section that needs to be filled. Likewise, the interior wall sheathing 386 attached to first frame structure 348 may extend to the top of the bottom top load bearing member 354. Similarly, the wall or sheetrock connected to second frame structure 350 may extend to the top of the bottom top load bearing member 354. This provides a uniform acoustic barrier between adjoining walls that is not present in FIG. 2B. That is, the interior sheetrock extends all the way up to the top of the bottom top load bearing member 226 and provides a solid sound barrier.

Moreover, as will be discussed in more detail below, the use of clips 378, 380 are internal to the exterior walls and can be done prior to sheet rocking. Thus, inspection time is reduced eliminating the need for intermediate inspection steps. For example, they minimize the scheduling interdependency of framing, installation of metal connectors, installation of sheathing, and installation of sheetrock pre-rock. Reducing this interdependency means the schedule for installing those systems can be compressed.

Finally, floor sheathing 390 may be supported by top chord 314 of truss 310 and blocking 318 and captured at the connection point via fastener 374. In sum, FIGS. 3A, 3B, and 3C illustrate one configuration wherein an embodiment of the present invention may be used at an exterior bearing wall. Other configurations where embodiments of the present invention may be implemented may be discussed in more detail below.

Embodiments of the present invention also make it easier to install piping and electrical wiring. Referring to FIG. 2A, the bottom chord bearing floor truss requires two penetrations to install pipe 270. Specifically, a hole has to be drilled in both top plate 226 and bottom plate 236. The distance between these plates complicates the alignment of the holes during the drilling operation. In addition, each hole or penetration has to be sealed individually. In contrast, embodiments of the present invention only require drilling one hole in the plates. Referring to FIG. 3A, the hybrid top chord bearing floor framing system only requires one penetration to install pipe 392. That is, a single hole can be drilled through top plates 354, blocking 318, and bottom plate 364 because they are joined together. This eliminates having to align two separate holes. Moreover, this completely eliminates multiple penetrations, meaning that only one penetration has to be sealed leading to a reduction in installation and inspection time. In addition, embodiments of the present invention eliminate conflict of penetrations with pre-rock fire-rated sheetrock.

Figure 4:
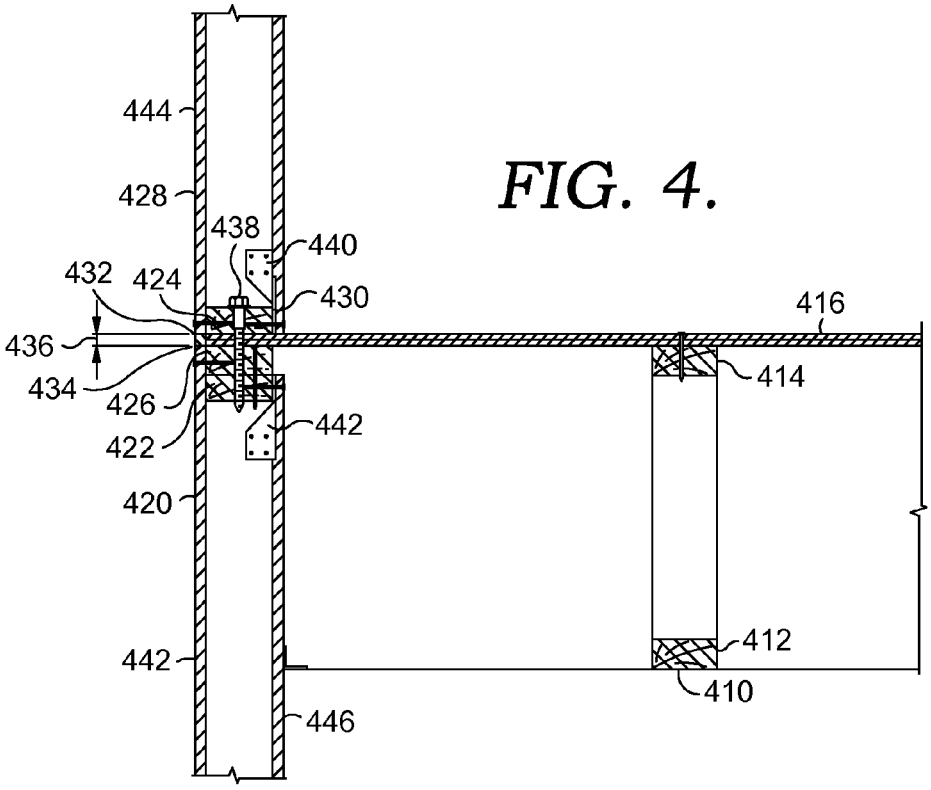
FIG. 4 is an exemplary view of an interface between an exemplary hybrid top chord bearing floor truss and an exterior wall, in accordance with an embodiment of the present invention.

FIG. 4 is an exemplary view of an interface between an exemplary hybrid top chord bearing floor truss parallel to an exterior wall. This configuration is referred to as a nonload bearing configuration because top chord bearing truss 410 is illustrated in a nonload bearing orientation. As before, top chord bearing truss 410 includes a bottom chord 412 and a top chord 414. Top chord 414 is shown supporting floor sheathing 416. The floor sheathing is supported by a first frame structure 420. First frame structure 420 includes top load bearing members 422. Likewise, first frame structure includes a bottom load bearing member (not illustrated) that may be supported by a foundation structure (not illustrated).

In addition, floor sheathing 416 may include a top surface 424 and a bottom surface 426. The bottom surface 426 of floor sheathing 416 is supported by the top load bearing members 422 of first frame structure 420. A second frame structure 428 includes a second load bearing member 430 and a top load bearing member (not illustrated). Second bottom load bearing member 430 is supported by a top surface 424 of the floor sheathing 416. Top surface 424 forms a first connection point 432 and bottom surface 426 forms a second connection point 434. Connection points 432 and 434 are separated by a distance 436. Again, this configuration minimizes distance 436 thereby providing structural advantages.

Moreover, FIG. 4 illustrates that this joint may be further strengthened via fastener 438 that extends through second bottom load bearing member 430 through floor sheathing 416 and into top load bearing members 422. Likewise, clips 440 and 442 may be connected to vertical-members associated with first frame structure 420 and second frame structure 428. Additionally, FIG. 4 illustrates that exterior wall or sheetrock 442 attached to first frame structure 420 may extend up to floor sheathing 416. Likewise, exterior wall 444 or sheetrock associated with the second frame structure 428 may extend to the top surface of floor sheathing 416. As will be illustrated in FIG. 5, this eliminates a drag truss that is required when using a bottom chord bearing framing structure. In addition, internal wall or sheetrock 446 associated with first frame structure 420 may extend to the top of the bottom top load bearing member 422. This eliminates the drag truss and the associated edge nailing required to install this truss. Moreover, this provides a continuous uniform sound barrier that is not present when implementing a drag truss.

Figure 5:
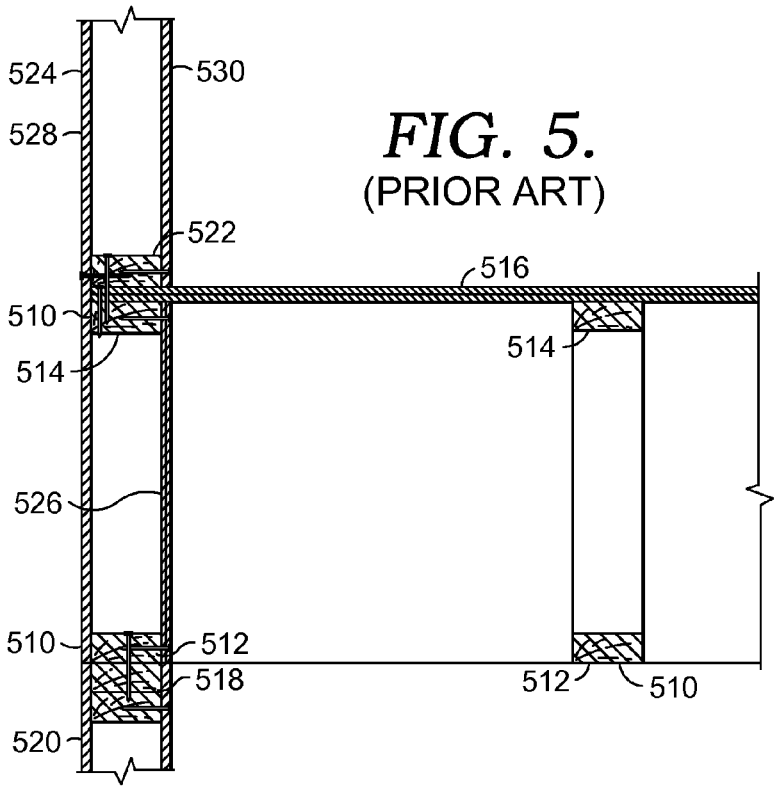
FIG. 5. (PRIOR ART)
FIG. 5 is an exemplary view of an interface between a bottom chord bearing floor truss and an exterior wall, the figure illustrates the prior art.

FIG. 5 is an exemplary view of an interface between a bottom chord bearing floor truss and an exterior wall. Bottom chord bearing floor truss 510 is illustrated with a bottom chord 512 and a top chord 514. Top chord 514 is supporting floor sheathing 516. In addition, bottom chord 512 is supported by top load bearing members 518 of a first frame structure 520. Top chord 514 is supporting floor sheathing 516 and a bottom load bearing member 522 of a second frame structure 524. As illustrated by FIG. 5, this configuration requires a drag truss 526 to fill the void between top loading bearing members 518 and floor sheathing 516. This requires special nailing to install the drag truss, as well as additional pieces of material that are not required by embodiments of the present invention. In sum, embodiments of the present invention eliminate the need of the drag truss, thus reducing material and hardware and expenses both in time and inspection. For instance, before installing an exterior wall 528 or interior wall 530, an inspector must come to inspect the installation of drag truss 526, thus requiring delay time in the production schedule. In contrast, embodiments of the present invention eliminate this inspection time and coordination by eliminating the need for a drag truss.

Figure 6:
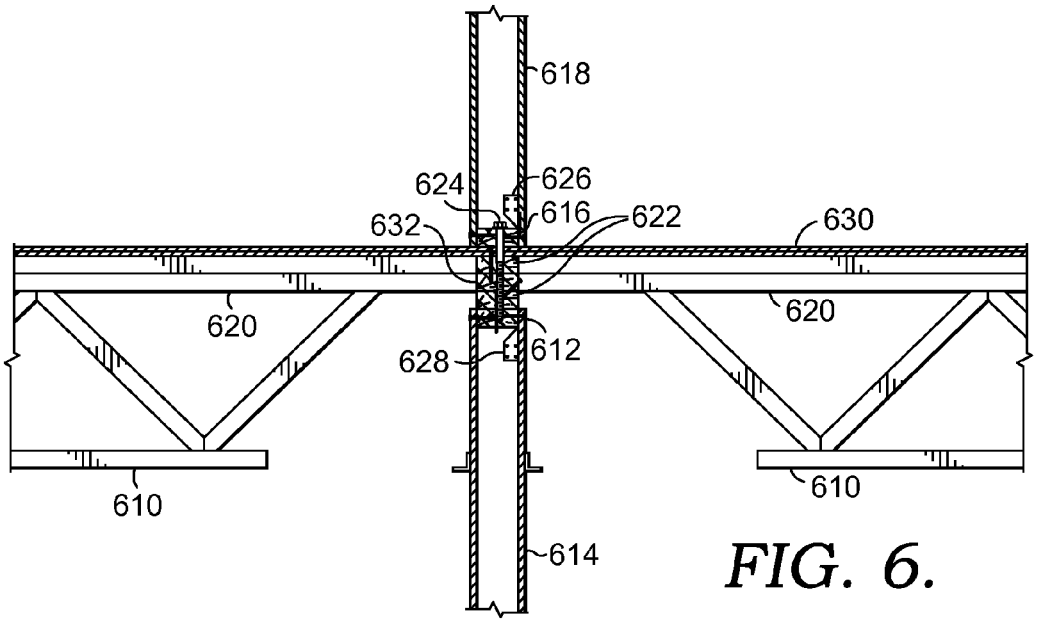
FIG. 6 is an exemplary view of an interface between an exemplary hybrid top chord bearing floor truss and an interior bearing wall and/or shear wall, in accordance with an embodiment of the present invention.

FIG. 6 is an exemplary view of an interface between an exemplary hybrid top chord bearing floor truss and an interior bearing wall or shear wall. The figure illustrates two top chord bearing trusses 610 supported by top load bearing members 612 of a first frame structure 614. A bottom load bearing member 616 of a second frame structure 618 is supported by floor sheathing 630 and the top chord of truss 610. In addition floor sheathing 630 is supported by blocking 632 between top chord bearing floor truss 610. Again, top chord 620 of the top chord bearing floor truss 610 may include a load bearing interface 622 that minimizes the distance between the connection points for the first frame structure and the second frame structure. As before, fastener 624 may provide additional mechanical strength by joining together second frame structure 618, load bearing surface 622, and first frame structure 614. Likewise, clips 626 and 628 may provide further mechanical support and resist uplift forces when connected between vertical-members or studs of the frame structures to the respective load bearing members.

Figure 7:
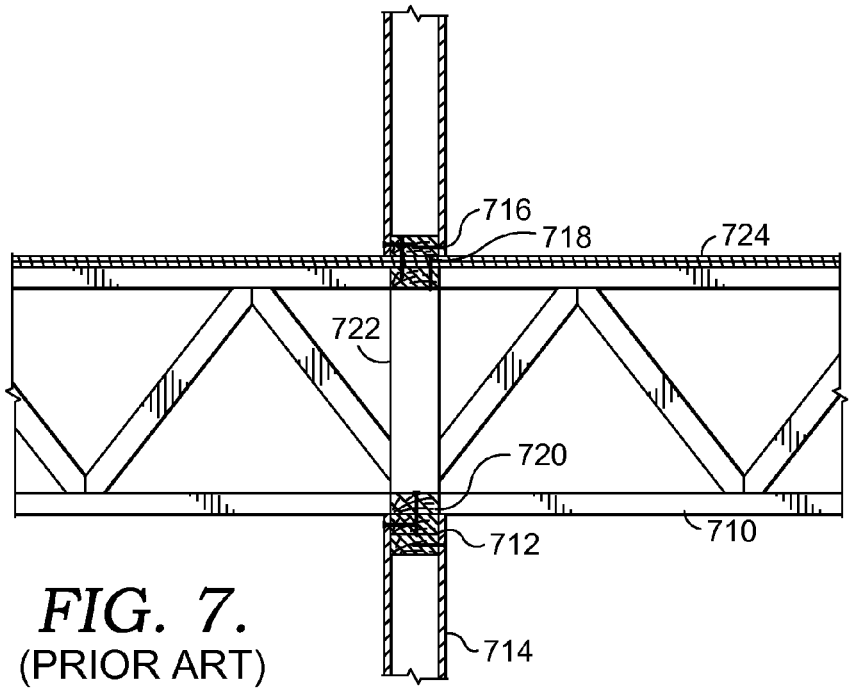
FIG. 7. (PRIOR ART)
FIG. 7 is an exemplary view of an interface between a bottom chord bearing floor truss and an interior bearing wall and/or shear wall, the figure illustrates the prior art.

FIG. 7 is an exemplary view of an interface between a bottom chord bearing floor truss and an interior bearing wall or shear wall. A comparison of FIG. 6 to FIG. 7 illustrates that components are eliminated by implementing embodiments of the present invention. Specifically, FIG. 7 illustrates a bottom chord bearing floor truss 710 that is supported by top load bearing members 712 of a first frame structure 714. Bottom load bearing member 716 is supported by the floor sheathing 724 and the top chord of the bottom chord bearing floor truss 710. These form two connection points 718 and 720 that are separated by a distance requiring additional structural support. Specifically, truss block 722 is required to bridge the gap between connection points 718 and 720. Again, FIG. 6 illustrates that this truss block is not required when embodiments of the present invention are used in this configuration. This reduces the amount of framing lumber required for blocking and plates. In addition, embodiments of the present invention make it is easy to buy nonstructural less expensive lumber for installation in the correct location. Also, because all floor trusses are top chord bearing and have the same profile, shop drawings and coordination time is drastically simplified.

Figure 8:
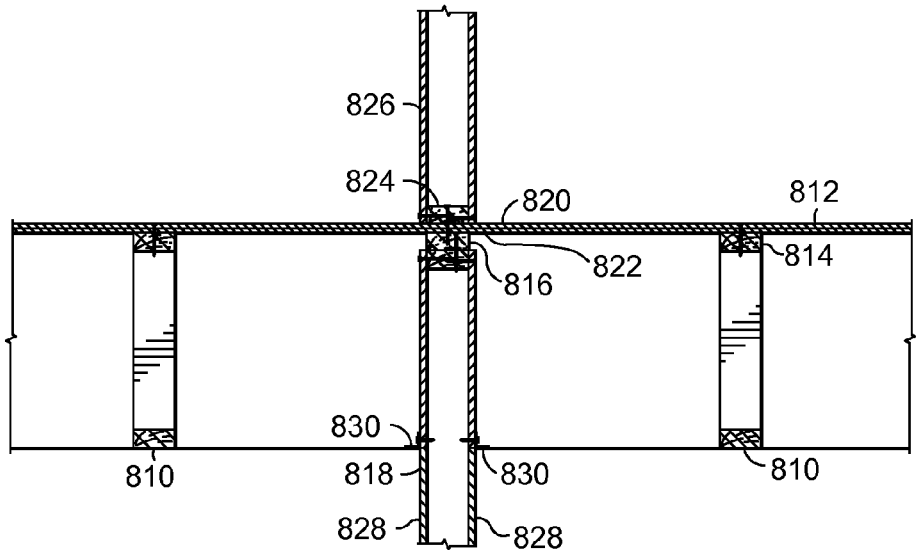
FIG. 8 is an exemplary view of an interface with an exemplary hybrid top chord bearing floor truss parallel to an interior bearing wall and/or shear wall, in accordance with an embodiment of the present invention.

FIG. 8 is an exemplary view of an interface between an exemplary hybrid top chord bearing floor truss parallel to an interior bearing wall or shear wall, in accordance with an embodiment of the present invention. As before, this configuration is referred to as a nonload bearing configuration because top chord bearing truss 810 is illustrated in a nonload bearing orientation. Top chord 812 of truss 810 supports floor sheathing 814, which is further supported by top load bearing members 816 of first frame structure 818. Floor sheathing 814 includes a top surface 820 and a bottom surface 822. Top surface 820 of floor sheathing 814 supports a bottom load bearing member 824 of a second frame structure 826. A comparison of FIG. 8 to FIG. 9 illustrates that embodiments of the present invention eliminates the necessary material and hardware.

Figure 9:
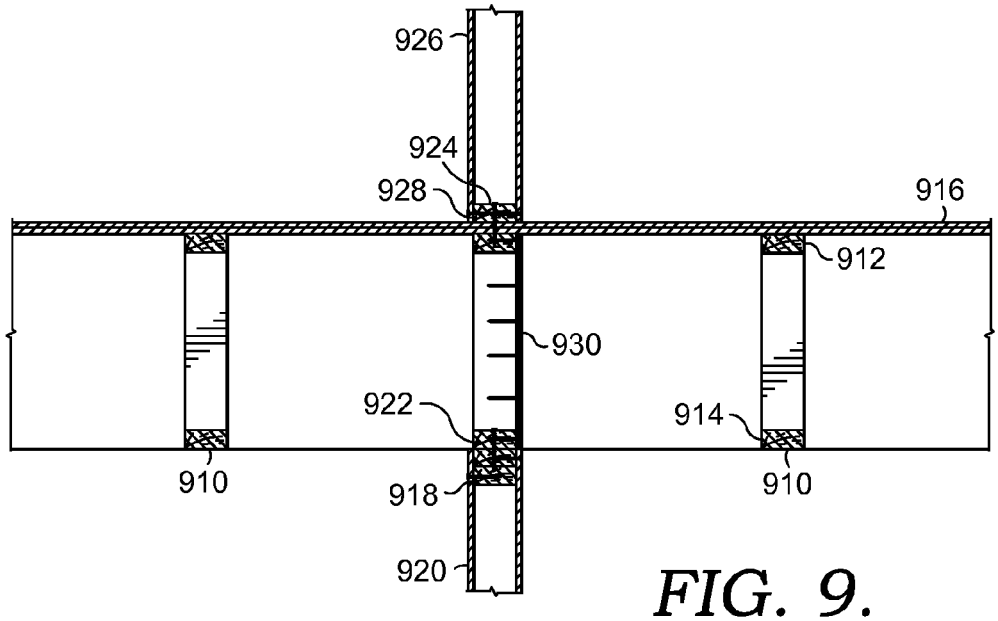
FIG. 9. (PRIOR ART)
FIG. 9 is an exemplary view of an interface with a bottom chord bearing floor truss parallel to an interior bearing wall and/or shear wall, the figure illustrates the prior art.

FIG. 9 is an exemplary view of an interface between a bottom chord bearing floor truss and an interior bearing wall or shear wall. Bottom chord bearing floor truss 910 has top chord 912 and bottom chord 914. Floor sheathing 916 is supported by top chord 912 of bottom chord bearing truss 910. Bottom chord 914 of the bottom chord bearing floor truss is supported by top load bearing members 918 of a first frame structure 920. This creates a first connection point 922. Likewise, top chord 912 supports floor sheathing 916 and a bottom load bearing member 924 of a second frame structure 926, which forms a second connection point 928. As illustrated in FIG. 9, the distance between first connection point 922 and second connection point 928 is bridged by a drag truss 930. This drag truss in not required when embodiments of the present invention are implemented. Again, the elimination of drag truss 930 reduces inspection time and installation time, as well as material cost. That is, time and resources are conserved because inspections for system components are taken off the critical path and can be done after framing is complete versus requiring mid-framing inspections. Moreover, the concern that the drag truss or pre-rock might get wet during construction is completely eliminated. In addition, as discussed, embodiments of the present invention provide a uniform sound barrier by allowing interior sheetrock 828 to extend up to the top of the bottom load bearing member 816. Likewise, clips 830 may be installed anytime after the sheetrock 828 is installed.

Figure 10:
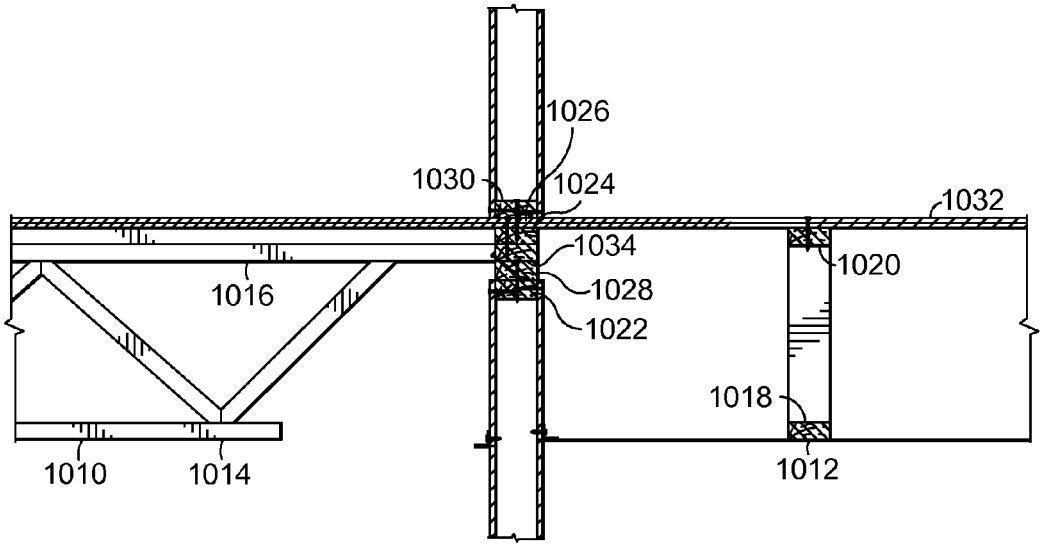
FIG. 10 is an exemplary view of an interface between an exemplary hybrid top chord bearing floor truss and an interior bearing wall and/or shear wall, in accordance with an embodiment of the present invention.

FIG. 10 is an exemplary view of an interface between an exemplary hybrid top chord bearing floor truss and an interior bearing wall or shear wall. The figure illustrates both a load bearing configuration and a nonload bearing configuration. Truss 1010 is illustrated in a load bearing configuration where truss 1012 is illustrated in a nonload bearing configuration. Truss 1010 includes a bottom chord 1014 and a top chord 1016. Likewise, truss 1012 includes a bottom chord 1018 and a top chord 1020. As before, for the load bearing configuration, truss 1010 is supported by first load bearing members 1022 of a first frame structure. Top chord 1016 includes a load bearing interface 1024 having a top surface 1026 and a bottom surface 1028. Bottom load bearing member 1030 of a second frame structure is supported by top surface 1026 of floor sheathing 1032 which is supported by the top load bearing chord 1016 blocking 1034 between top chord bearing floor truss 1010. Thus, connection points are included at top surface 1026 and bottom surface 1028 of load bearing interface 1024. Floor sheathing 1032 may be supported by the top surface of top chord 1016, 1020. Comparing FIG. 10 to FIG. 11 will illustrate how embodiments of the present invention eliminate hardware requirements.

Figure 11:
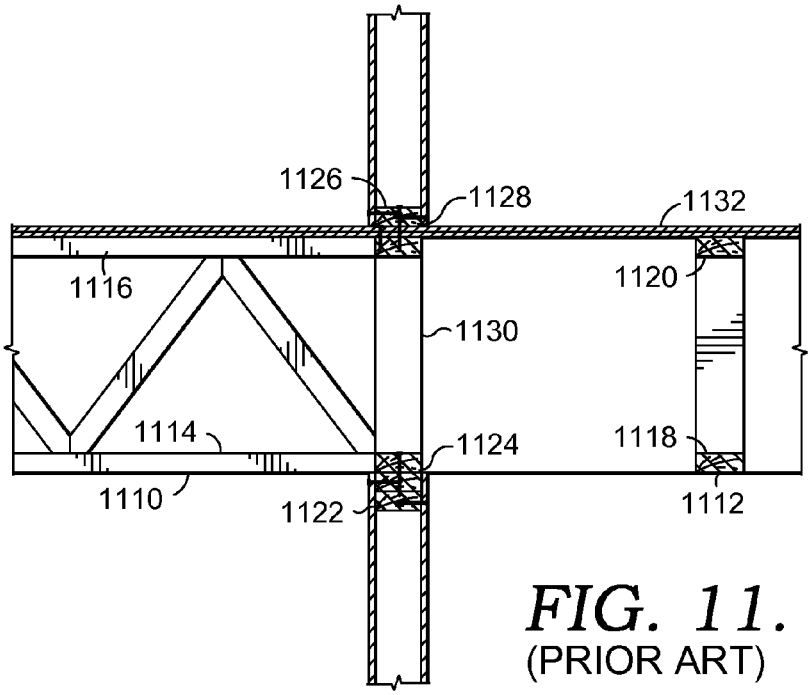
FIG. 11. (PRIOR ART)
FIG. 11 is an exemplary view of an interface between a bottom chord bearing floor truss and an interior bearing wall and/or shear wall, the figure illustrates the prior art.

FIG. 11 is an exemplary view of an interface between a bottom chord bearing floor truss and an interior bearing wall or shear wall. Similar to FIG. 10, FIG. 11 illustrates both a load bearing configuration and a nonload bearing configuration. Specifically, bottom chord bearing floor trusses 1110, 1112 are shown. Bottom chord bearing floor truss 1110 includes a bottom chord 1114 and a top chord 1116. Likewise, bottom chord bearing floor truss 1112 includes a bottom chord 1118 and a top chord 1120. Bottom chord 1114 is supported by top load bearing members 1122 that is associated with the first frame structure. This forms a first connection point 1124. Bottom load bearing member 1126 is associated with a second frame structure supported by top chord 1116 forming a second connection point 1128. A truss block 1130 is used to bridge the gap between connection point 1128 and 1124. Referring to FIG. 10, truss block 1130 is not required when embodiments of the present invention are implemented for the illustrated configurations. Again, this reduces hardware requirements leading to savings on both material and installation cost.

Figure 12:
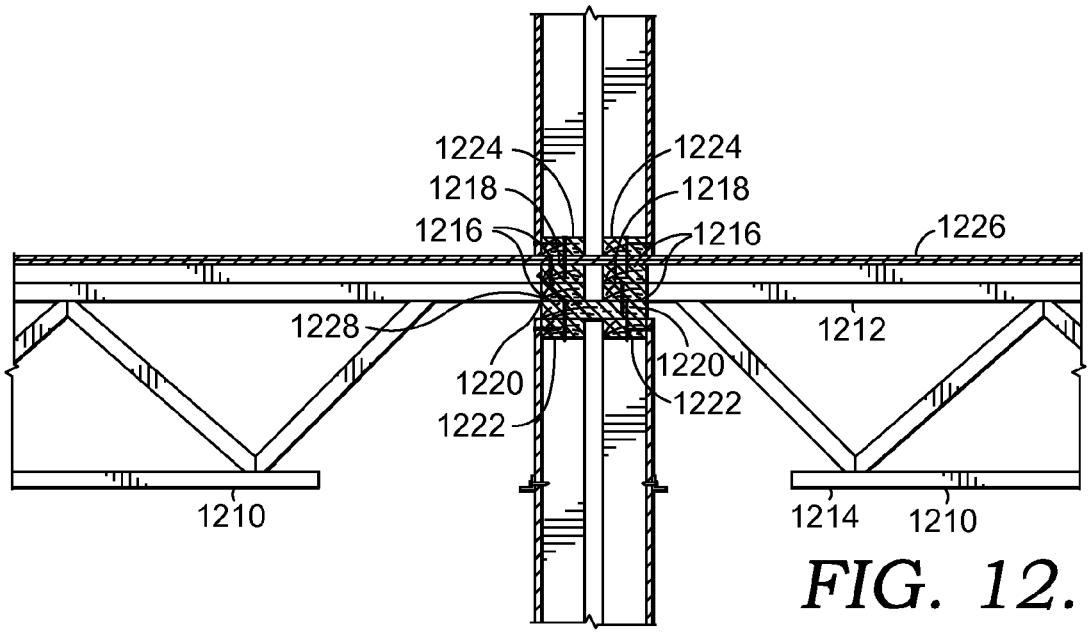
FIG. 12 is an exemplary view of an interface between an exemplary hybrid top chord bearing floor truss and a party wall and/or shear wall, in accordance with an embodiment of the present invention.

FIG. 12 is an exemplary view of an interface between an exemplary hybrid top chord bearing floor truss and a party wall. Specifically, top chord bearing floor truss 1210 is illustrated in a load bearing configuration. Top chord bearing floor truss 1210 includes a top chord 1212 and a bottom chord 1214. Top chord 1212 includes a load bearing interface 1216 having a top surface 1218 and a bottom surface 1220. Top chord 1212 is supported by top load bearing members 1222 associated with a first frame structure. A second bottom load bearing member 1224 associated with a second frame structure is supported by floor sheathing 1226, top surface 1218 of top chord 1212 and blocking 1228 between top chord bearing floor truss 1210. A comparison of FIG. 12 to FIG. 13 once again illustrates that embodiments of the present invention eliminate hardware.

Figure 13:
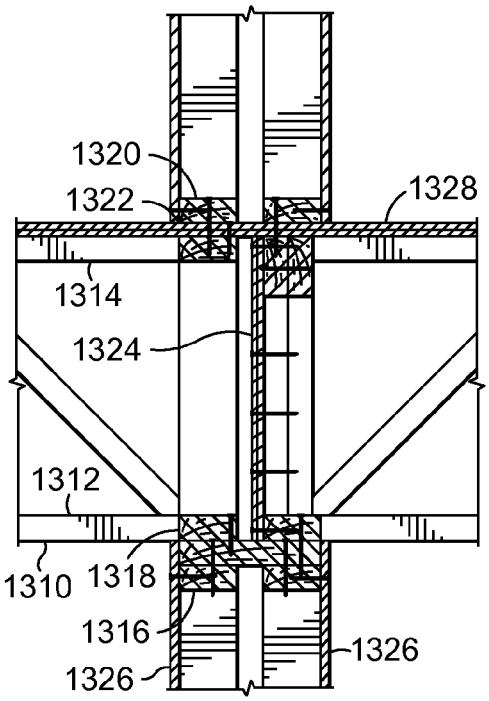
FIG. 13. (PRIOR ART)
FIG. 13 is an exemplary view of an interface between a bottom chord bearing floor truss and a party wall and/or shear wall, the figure illustrates the prior art.

Specifically, FIG. 13 is an exemplary view of an interface between a bottom chord bearing floor truss and a party wall. Bottom chord bearing floor truss 1310 includes a bottom chord 1312 and a top chord 1314. Bottom chord 1312 is supported by top load bearing members 1316 forming a first connection point 1318. A bottom load bearing member 1320 is supported by a top chord 1314 forming a second connection point 1322. To bridge the gap between the connection points 1318 and 1322, a wood structural panel 1324 is implemented. As one skilled in the art would appreciate, the installation of wood structural panel 1324 must be inspected before sheetrock 1326 can be installed. Thus, by eliminating the need for the wood structural panel 1324, embodiments of the present invention reduce inspection time and streamline critical path inspections. Specifically, wood structural panel 1324 is typically required for fire protection and to prevent draft between adjoining walls. As illustrated by FIG. 12, the distance between connection points is not only minimized, but also eliminates the need for any open draft area that must be filled by the structural panel. Thus, the associated material and hardware and the labor for installing the wood structural panel are eliminated. Likewise, the inspection time to ensure the structural panel meets building codes is also eliminated.

Figure 14:
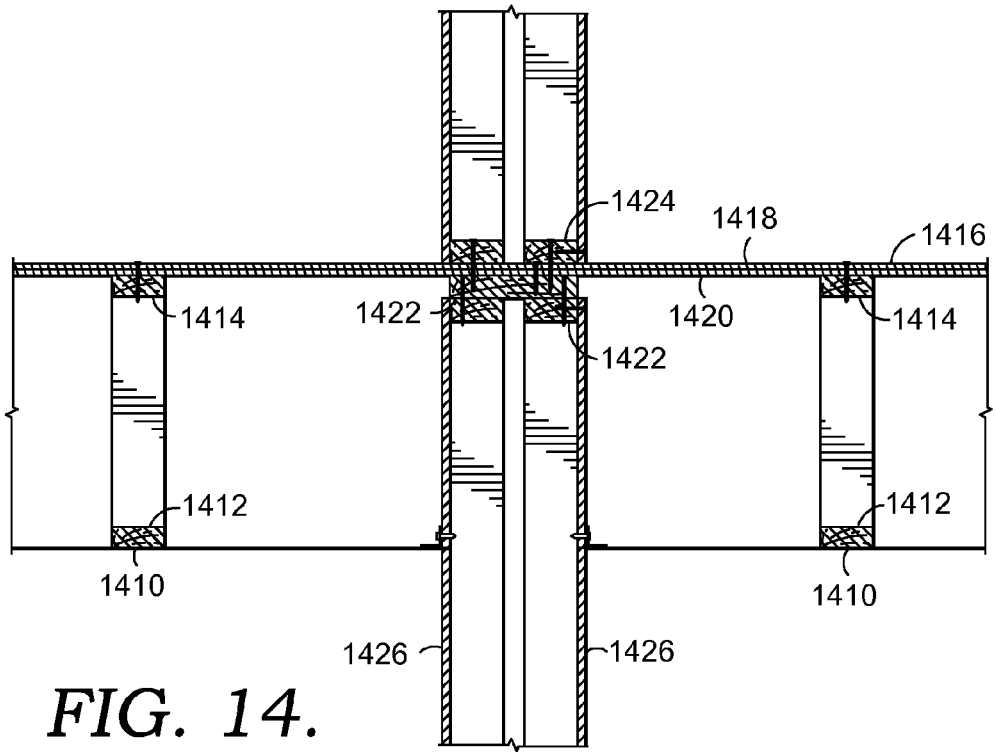
FIG. 14 is an exemplary view of an interface with an exemplary hybrid top chord bearing floor truss parallel to a party wall and/or shear wall, in accordance with an embodiment of the present invention.

FIG. 14 is an exemplary view of an interface between an exemplary hybrid top chord bearing floor truss parallel to a party wall. Specifically, FIG. 14 illustrates a top chord bearing floor truss 1410 in a nonload bearing configuration. Top chord bearing floor truss 1410 includes a bottom chord 1412 and a top chord 1414. Top chord 1414 supports floor sheathing 1416. Floor sheathing 1416 includes a top surface 1418 and a bottom surface 1420. Bottom surface 1420 of floor sheathing 1416 is supported by top load bearing members 1422 associated with a first structure. A bottom load bearing member 1424 is supported by the top surface 1418 of floor sheathing 1416.

Figure 15:
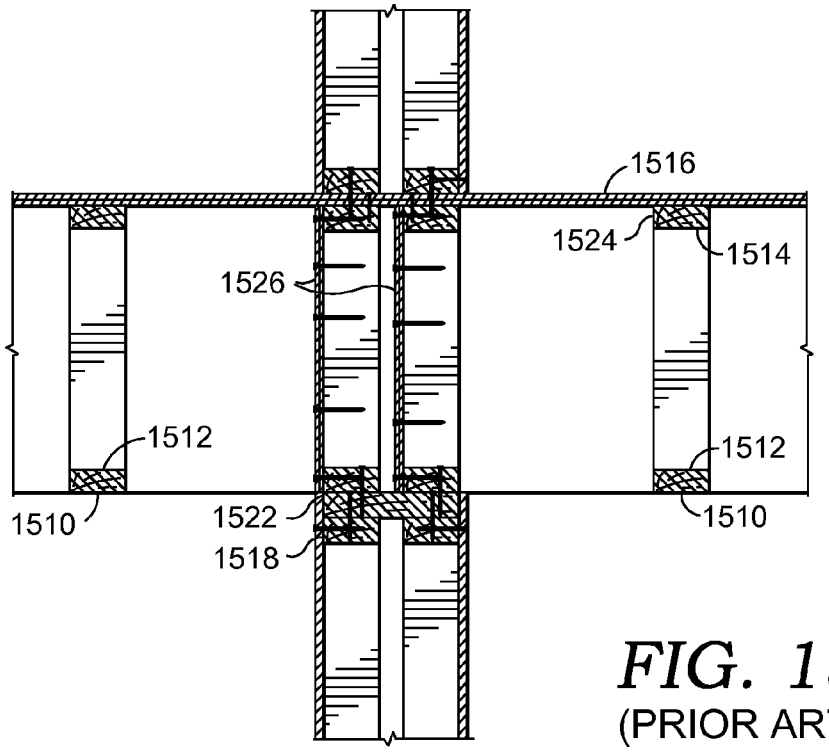
FIG. 15. (PRIOR ART)
FIG. 15 is an exemplary view of an interface between a bottom chord bearing floor truss parallel to a party wall and/or shear wall, the figure illustrates the prior art.

FIG. 15 is an exemplary view of an interface between a bottom chord bearing floor truss parallel to a party wall. Bottom chord bearing floor truss 1510 includes a bottom chord 1512 and a top chord 1514. Top chord 1514 supports a floor sheathing 1516. Bottom chord 1512 of truss 1510 is supported by a top load bearing member 1518. This support creates a first connection point 1522. Likewise, the support of floor sheathing by top chord 1514 creates a second connection point 1524. Drag truss 1526 is required to bridge the gap between connection point 1522 and connection point 1524. Again, this may be because fire safety codes require draft protection at party walls or related frame structures.

Comparing FIG. 15 to FIG. 14, one of ordinary skill in the art would recognize that the need for a drag truss is eliminated by embodiments of the present invention. This is because sheetrock on interior walls 1426 can extend up to the top of the bottom top load bearing member 1422. Thus, not only is the installation and the hardware requirements of a drag truss eliminated, but also a uniform sound barrier is provided. In addition, the related hardware such as the nails and the scheduling of inspections are drastically reduced or eliminated because the drag truss is no longer required.

Figure 16:
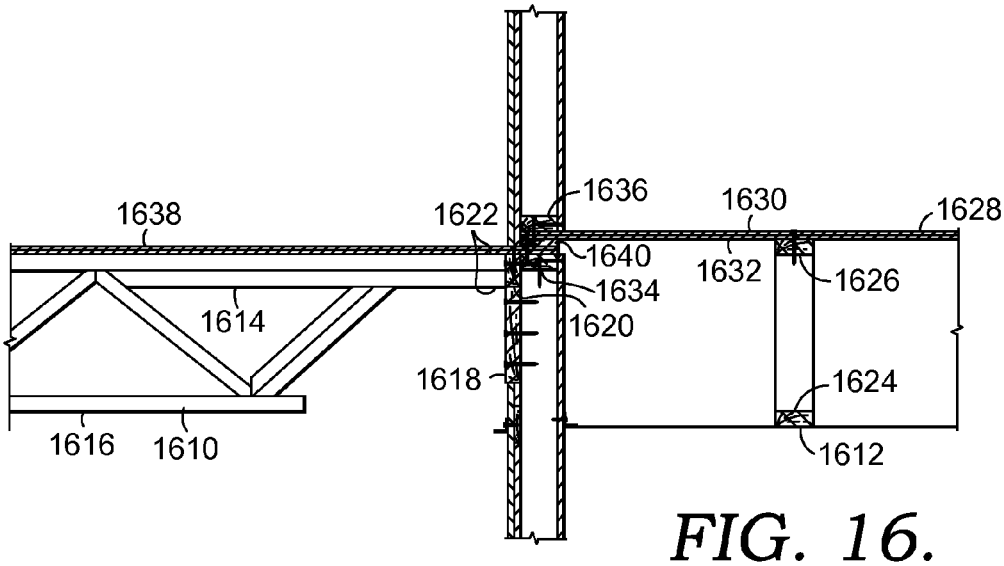
FIG. 16 is an exemplary view of a corridor interface between an exemplary hybrid top chord bearing floor truss and an exemplary wall, in accordance with an embodiment of the present invention.

FIG. 16 is an exemplary view of a corridor interface between an exemplary hybrid top chord bearing floor truss and an exemplary wall. Specifically, top chord bearing floor truss 1610 is illustrated in a load bearing orientation and top chord bearing floor truss 1612 is illustrated in a nonload bearing configuration. Top chord bearing floor truss 1610 includes a top chord 1614 and a bottom chord 1616. Top chord 1614 is supported by a ledger 1618. Specifically, the bottom surface 1620 of load bearing interface 1622 is supported by a top surface of ledger 1618. Likewise, top chord bearing floor truss 1612 includes a bottom chord 1624 and a top chord 1626. Floor sheathing 1628 is supported by the top chord 1626 of truss 1612. In addition, floor sheathing 1628 includes a top surface 1630 and a bottom surface 1632. Bottom surface 1632 of floor sheathing 1628 and bottom load bearing member 1636 of a second frame structure floor sheathing 1638, member 1640 a top load bearing member 1634 of a first frame structure.

Figure 17:
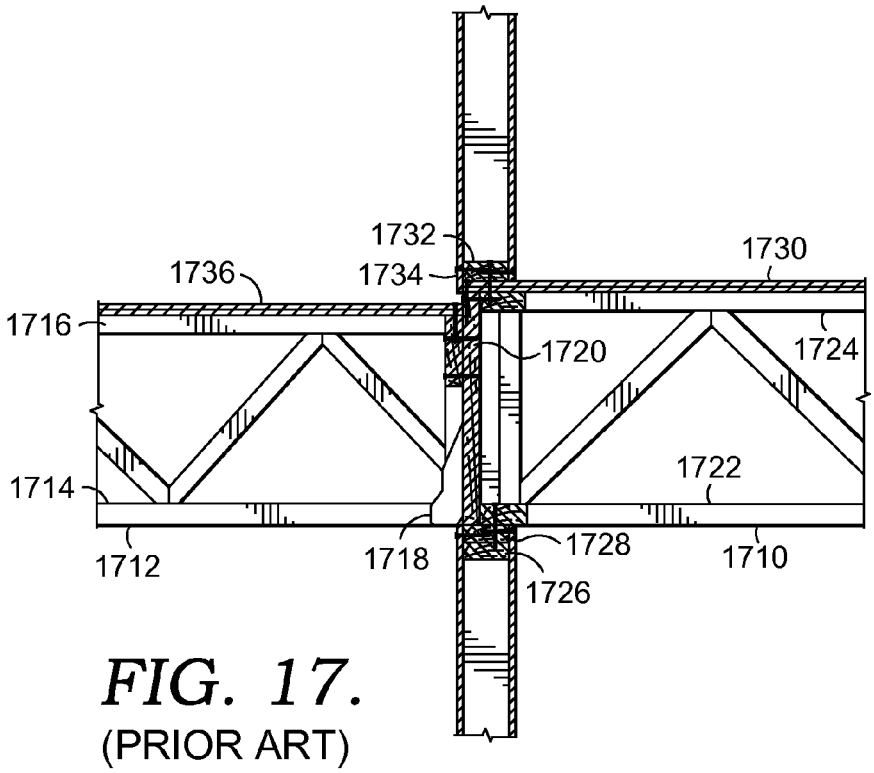
FIG. 17. (PRIOR ART)
FIG. 17 is an exemplary view of a corridor interface between a bottom chord bearing floor truss and an exemplary wall, the figure illustrates the prior art.

FIG. 17 is an exemplary view of a corridor interface between a bottom chord bearing floor truss and an exemplary wall. Specifically, bottom chord bearing floor truss 1710 and 1712 are illustrated in a load bearing orientation. Bottom load bearing floor truss 1712 includes a bottom chord 1714 and a top chord 1716. Bottom chord 1714 is supported by a hanger 1718 connected to rim board 1720. Bottom chord bearing floor truss 1710 includes a bottom chord 1722 and a top chord 1724. Rim board 1720 and bottom chord 1722 are supported by first top load bearing members 1726 associated with a first frame structure. This support forms a first connection point 1728. Floor sheathing 1730 is supported by top chord 1724, which further supports bottom load bearing member 1732 of a second frame structure. This forms a connection point 1734.

Comparing FIG. 17 to FIG. 16, one of ordinary skill in the art would appreciate that embodiments of the present invention eliminate the need for both hangar 718 and rim board 1720. This is because the distance between connection points 1734 and 1728 is drastically reduced by using embodiments of the top chord bearing floor framing system. Again, this eliminates material and hardware and reduces the installation time to install such hardware. Moreover, the reduced distance between the connection points provides an improved mechanical structure.

Figure 18:
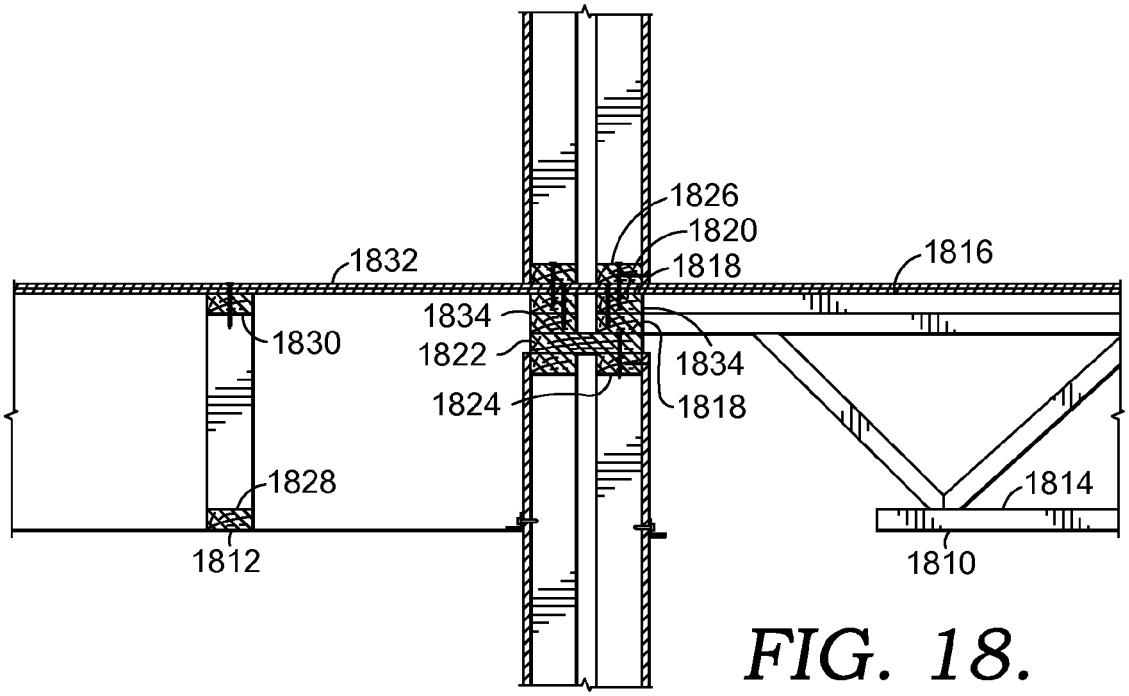
FIG. 18 is an exemplary view of an interface between an exemplary hybrid top chord bearing floor truss and a party wall and/or shear wall, in accordance with an embodiment of the present invention.

FIG. 18 is an exemplary view of an interface between an exemplary hybrid top chord bearing floor truss and a party wall. The figure illustrates both a nonload bearing and a load bearing configuration. Specifically, top chord bearing floor truss 1810 is illustrated in a load bearing configuration and top chord bearing floor truss 1812 is illustrated in a nonload bearing configuration. Top chord bearing floor truss 1810 includes a bottom chord 1814 and a top chord 1816. Top chord 1816 includes a load bearing interface 1818 having a top surface 1820 and a bottom surface 1822. Bottom surface 1822 of load bearing interface 1818 is supported by top load bearing members 1824 associated with a first frame structure. Bottom load bearing member 1826 associated with a second frame structure is supported by top surface 1820 of top chord 1816. Top chord bearing floor truss 1812 includes a bottom chord 1828 and a top chord 1830. Top chord 1830 supports floor sheathing 1832, which is further supported by blocking members 1834, which is supported by top load bearing members 1824. In addition floor sheathing 1832 is supported by blocking 1834 between top chord bearing floor trusses 1810.

Figure 19:
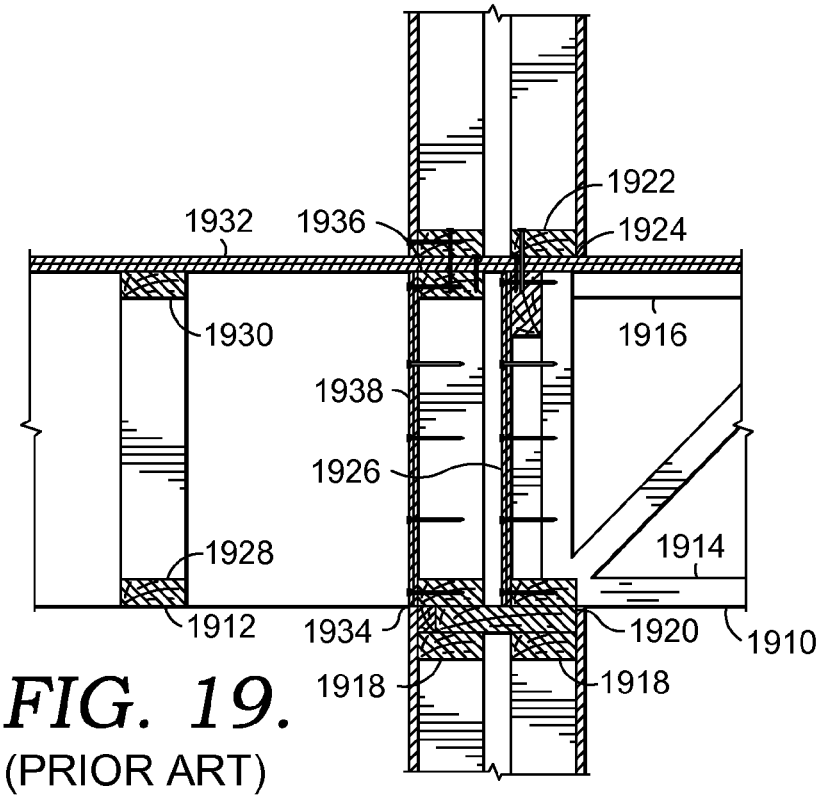
FIG. 19. (PRIOR ART)
FIG. 19 is an exemplary view of an interface between a bottom chord bearing floor truss parallel to a party wall and/or shear wall, the figure illustrates the prior art.

FIG. 19 is an exemplary view of an interface between a bottom chord bearing floor truss and a party wall. The figure illustrates both a nonload bearing and a load bearing configuration. Specifically, bottom load bearing floor truss 1910 is illustrated in a load bearing configuration and bottom load bearing floor truss 1912 is illustrated in a nonload bearing configuration. Bottom load bearing floor truss 1910 includes a bottom chord 1914 and a top chord 1916. Bottom chord 1914 is supported by first load bearing members 1918 associated with a first frame structure. This support forms a first connection point 1920. Bottom load bearing member 1922 associated with a second frame structure is supported by top chord 1916 of truss 1910. This forms a second connection point 1924. Wood structural panels 1926 bridge the gap between connection point 1920 and 1924.

Similarly, bottom chord bearing floor truss 1912 includes a bottom chord 1928 and a top chord 1930. Floor sheathing 1932 is supported by top chord 1930. A drag truss 1938 or knee wall truss is used to bridge the gap between connection points 1934 and 1936.

Comparing FIG. 19 to FIG. 18, one of ordinary skill in the art would appreciate that embodiments of the present invention eliminate the need for both a wood structural panel 1926 and a drag truss or knee wall truss 1938. This is because the distance between connection points is drastically reduced by using embodiments of the top chord bearing framing system. Again, this eliminates material and hardware and reduces the installation time to install such hardware. Moreover, the reduced distance between the connection points provides an improved mechanical structure.

Figure 20:
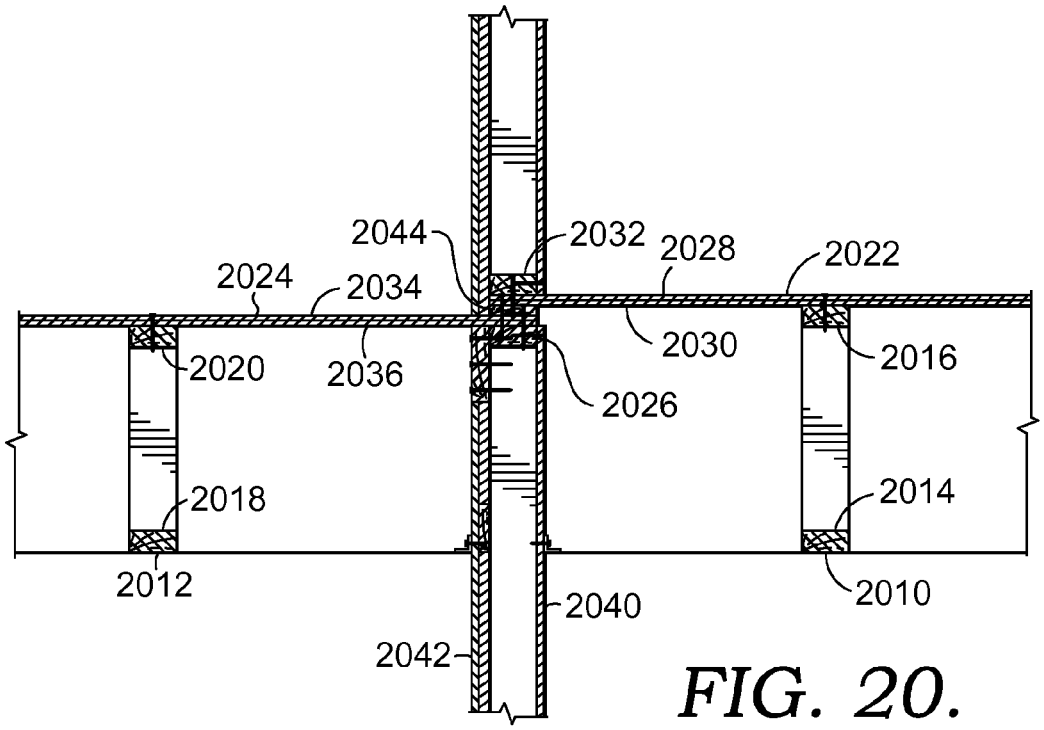
FIG. 20 is an exemplary view of a corridor interface with an exemplary hybrid top chord bearing floor truss parallel to an exemplary wall, in accordance with an embodiment of the present invention.

FIG. 20 is an exemplary view of a corridor interface between an exemplary hybrid top chord bearing floor truss parallel to an exemplary wall. The figure illustrates top chord bearing floor truss 2010 and 2012 in a nonload bearing orientation. Top chord bearing floor truss 2010 includes a bottom chord 2014 and a top chord 2016. Likewise top chord bearing floor truss 2012 includes a bottom chord 2018 and a top chord 2020. Floor sheathing 2022 and 2024 are supported by top chord 2016 and 2020, respectively. In addition, floor sheathing 2022 is supported by floor sheathing 2024, member 2044 and first top load bearing member 2026 associated with a first frame structure. Floor sheathing 2022 includes a top surface 2028 and a bottom surface 2030. A second bottom load bearing member 2032 of a second frame structure is supported by the top surface 2028 of floor sheathing 2022. Likewise, floor sheathing 2024 includes top surface 2034 and bottom surface 2036. Bottom surface 2036 of floor sheathing 2024 is supported by ledger top load top load bearing member 2026.

Figure 21:
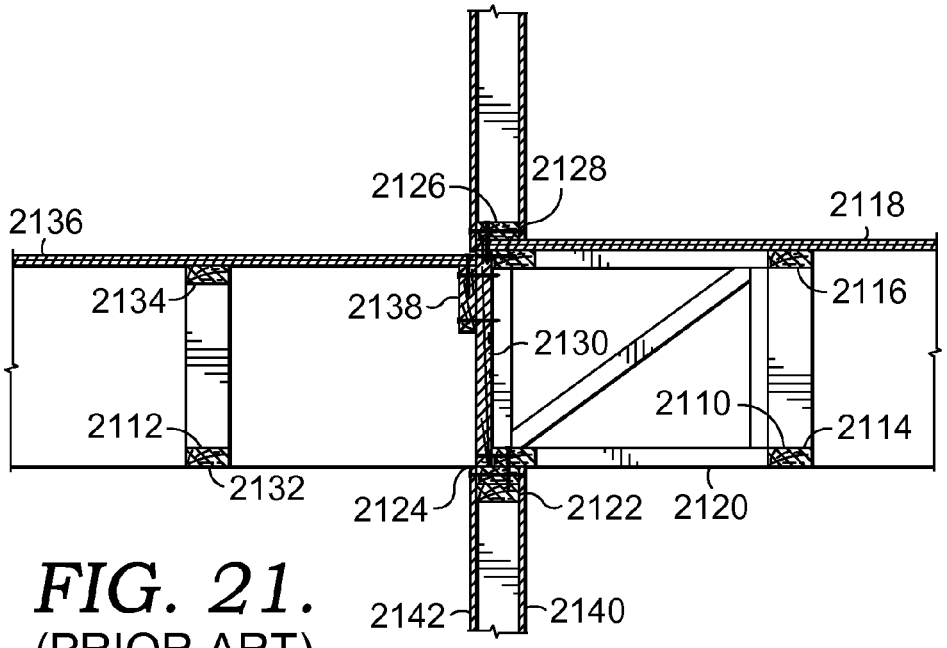
FIG. 21. (PRIOR ART)
FIG. 21 is an exemplary view of a corridor interface with a bottom chord bearing floor truss parallel to an exemplary wall, the figure illustrates the prior art.

FIG. 21 is an exemplary view of a corridor or interface between a bottom chord bearing floor truss parallel to an exemplary wall. Specifically, bottom chord bearing floor truss 2110 and 2112 are illustrated in a nonload bearing configuration. Bottom chord bearing floor truss 2110 includes a bottom chord 2114 and a top chord 2116. Floor sheathing 2118 is supported by top chord 2116 of bottom chord truss 2110. In addition floor sheathing 2118 is supported by truss block 2120, which is further supported by first load bearing members 2122 associated with a first frame structure. This forms connection point 2124. A bottom load bearing member 2126 associated with a second frame structure is also supported by truss block 2120 at a second connection point 2128. The gap between connection points 2128 and 2124 is bridged with rim board 2130. Bottom chord bearing floor truss 2112 includes a bottom chord 2132 and a top chord 2134. Floor sheathing 2136 is supported by top chord 2134 of bottom chord bearing floor truss 2112. Additionally, floor sheathing 2136 is supported by a ledger 2138 that is connected to rim board 2130.

Comparing FIG. 20 to FIG. 21, one of ordinary skill in the art would appreciate that embodiments of the present invention eliminate the need for both rim board 2130, ledger 2138, and truss block 2120. This is because the distance between connection points is drastically reduced by using embodiments of the top chord bearing floor framing system. This once again eliminates material and hardware and reduces the installation time to install such material and hardware. In addition, sheetrock on walls 2040 can extend to the top of the bottom top load bearing member 2026. Similarly, sheetrock 2042 can extend to the top of the bottom top load bearing member 2026. This is not possible when using a bottom chord bearing floor truss system because it requires the use of rim boards or structural panels, as illustrated in FIG. 21. Specifically, sheetrock 2140 only extends up to the bottom surface of truss block 2120. Likewise, sheetrock 2142 extends only to the first connection point 2124 at the bottom of rim board 2130.

Figure 22:
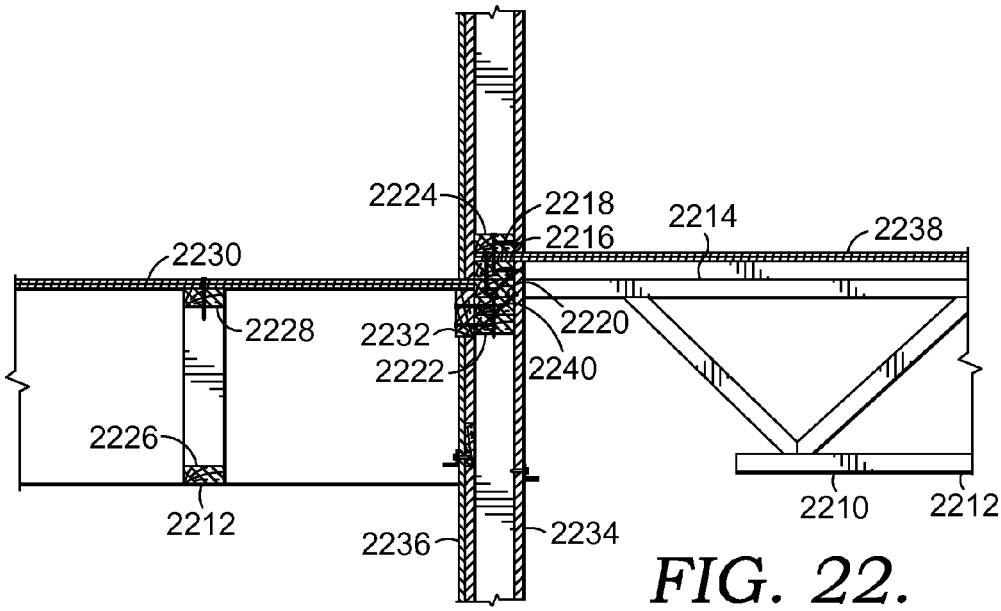
FIG. 22 is an exemplary view of a corridor interface with an exemplary hybrid top chord bearing floor truss parallel to an exemplary wall, in accordance with an embodiment of the present invention.

FIG. 22 is an exemplary view of a corridor interface between an exemplary hybrid top chord bearing floor truss and an exemplary wall. Specifically, FIG. 22 illustrates top chord bearing floor truss 2210 in a load bearing configuration and top chord bearing floor truss 2212 in a nonload bearing configuration. Top chord bearing floor truss 2210 includes a bottom chord 2213 and a top chord 2214. Top chord 2214 includes a load bearing interface 2216 having a top surface 2218 and a bottom surface 2220. Bottom surface 2220 of top chord 2214 is supported by first load bearing members 2222 that is associated with a first frame structure. Bottom load bearing member 2224 associated with a second frame structure is supported by top surface 2218 of top chord 2214 and floor sheathing 2238 and blocking 2240 between top chord bearing floor truss 2210. Top chord bearing floor truss 2212 includes a bottom chord 2226 and a top chord 2228. Floor sheathing 2230 is supported by top chord 2228, as well as ledger 2232.

Figure 23:
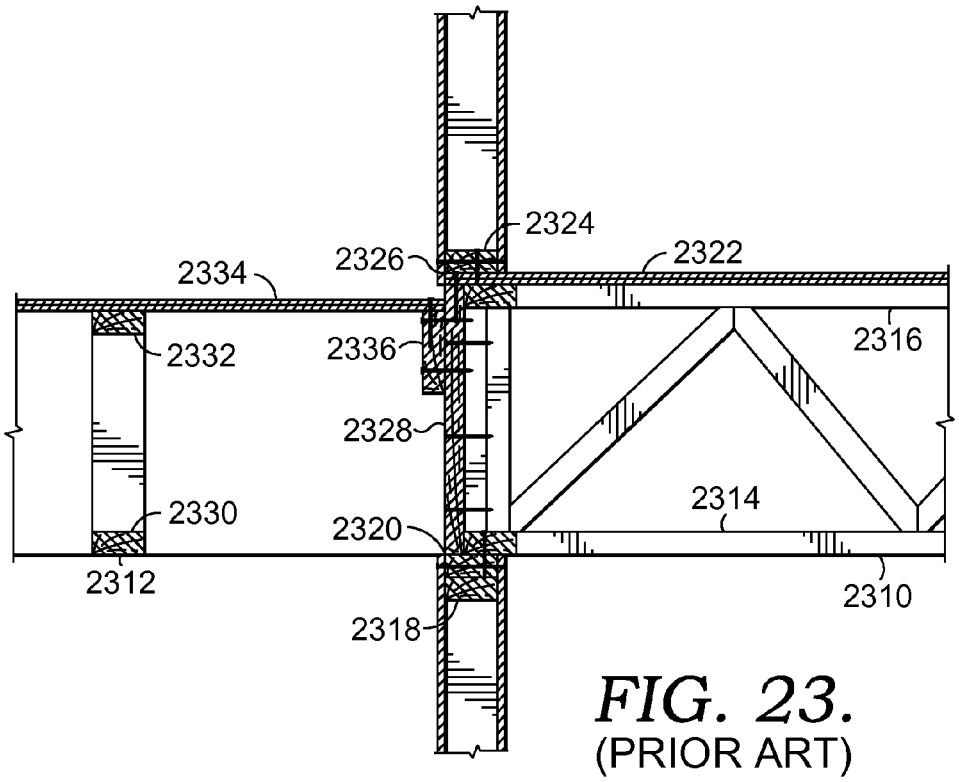
FIG. 23. (PRIOR ART)
FIG. 23 is an exemplary view of a corridor interface with a bottom chord bearing floor truss parallel to an exemplary wall, the figure illustrates the prior art.

FIG. 23 is an exemplary view of a corridor interface between a bottom chord bearing floor truss and an exemplary wall. Specifically, bottom chord bearing floor truss 2310 is illustrated in a load bearing configuration and bottom chord bearing floor truss 2312 is illustrated in a nonload bearing orientation. Bottom chord bearing floor truss 2310 includes bottom chord 2314 and top chord 2316. Bottom chord 2314 is supported by first load bearing members 2318 that is associated with a first frame structure. This forms a connection point 2320 between the first frame structure and the bottom load bearing truss 2310. Floor sheathing 2322 is supported by a top chord 2316. Bottom load bearing member 2324 associated with a second frame structure is also supported by top chord 2316. This forms a second connection point 2326. The distance between connection point 2320 and connection point 2326 is bridged with a rim board 2328. Likewise, bottom chord bearing floor truss 2312 includes bottom chord 2330 and top chord 2332. Floor sheathing 2334 is supported by top chord 2332 and ledger 2336.

Comparing FIG. 22 to FIG. 23, one of ordinary skill in the art would appreciate that embodiment of the present invention eliminate the need for rim board 2328. This is because the distance between the connection points is drastically reduced by using embodiment of the top chord bearing floor framing system. This once again eliminates materials and hardware and reduces the installation time to install such hardware. In addition, sheetrock 2236 may extend all the way flush to ledger 2232 providing a uniform draft and sound barrier. Sheetrock 2234 may extend to the top of the bottom top load bearing member 2222. It should be noted that the term flush includes not only walls in contact, but also includes walls in close proximity of one another even though they may not be in direct contact. In other words, flush includes the scenario where a gap is purposely left for expansion/contraction of the structure.

Figure 24:
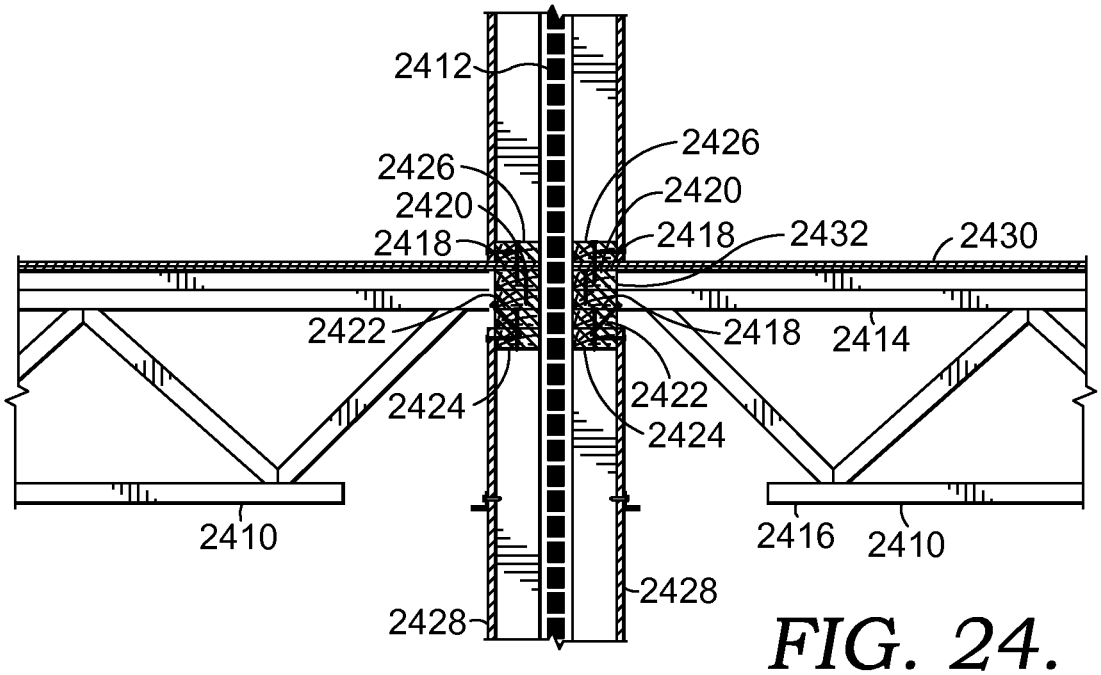
FIG. 24 is an exemplary view of an interface between an exemplary hybrid top chord bearing floor truss and a two-hour firewall, in accordance with an embodiment of the present invention.

FIG. 24 is an exemplary view of an interface between an exemplary hybrid top chord bearing floor truss and a two-hour firewall 2412. Specifically, top chord bearing floor truss 2410 is illustrated in a load bearing configuration on either side of the two-hour fire separation wall 2412. One skilled in the art will appreciate that two-hour fire separation wall 2412 may be required for local fire codes to prevent a fire from spreading to adjacent sides of a structure that share a common wall. As before, top chord bearing floor truss 2410 may include a top chord 2414 and a bottom chord 2416. Top chord 2414 may include a load bearing interface 2418 having a top surface 2420 and a bottom surface 2422. Bottom surface 2422 may be supported by first load bearing members 2424 associated with a first frame structure. Bottom load bearing member 2426 associated with a second frame structure may be supported by a top surface 2420 of load bearing interface 2418. In addition floor sheathing 2430 is supported by blocking 2432 between top chord bearing floor truss 2410.

Figure 25:
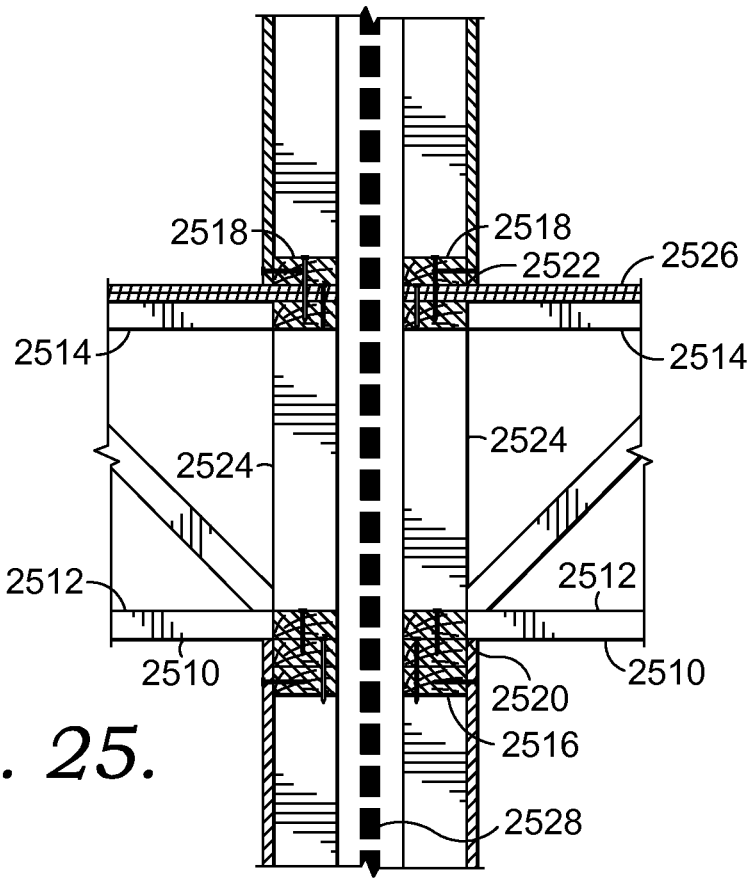
FIG. 25 is an exemplary view of an interface between a bottom chord bearing floor truss and a two-hour firewall, the figure illustrates the prior art.

FIG. 25 is an exemplary view of an interface between a bottom chord bearing truss and a two-hour firewall 2528. Bottom chord bearing floor truss 2510 is illustrated in a load bearing orientation. Bottom chord bearing floor truss 2510 includes bottom chord 2512 and top chord 2514. Bottom chord 2512 is supported by first load bearing members 2516 associated with a first frame structure. Bottom load bearing member 2518 associated with a second frame structure is supported by floor sheathing 2526 and top chord 2514 of truss 2524. Connection points 2520 and 2522 are provided at both the bottom chord support location and the top chord support location as illustrated. The distance between connection points 2520 and 2522 is spanned with truss block 2524. Truss block 2524 is required in part to counteract the domino effect from the large gap that results between connection points 2520 and 2522 when implementing a bottom chord bearing floor truss.

Comparing FIG. 24 to FIG. 25, one of ordinary skill in the art would appreciate that embodiments of the present invention eliminate the need for truss block 2524. This is because the distance between the connection points is drastically reduced by using an embodiment of the top chord bearing floor framing system. This once again eliminates material and hardware and reduces the installation time to install such material and hardware. In addition, sheetrock on walls 2428 may extend to the top of the bottom top load bearing member 2424 providing a uniform draft and sound barrier.

Figure 26:
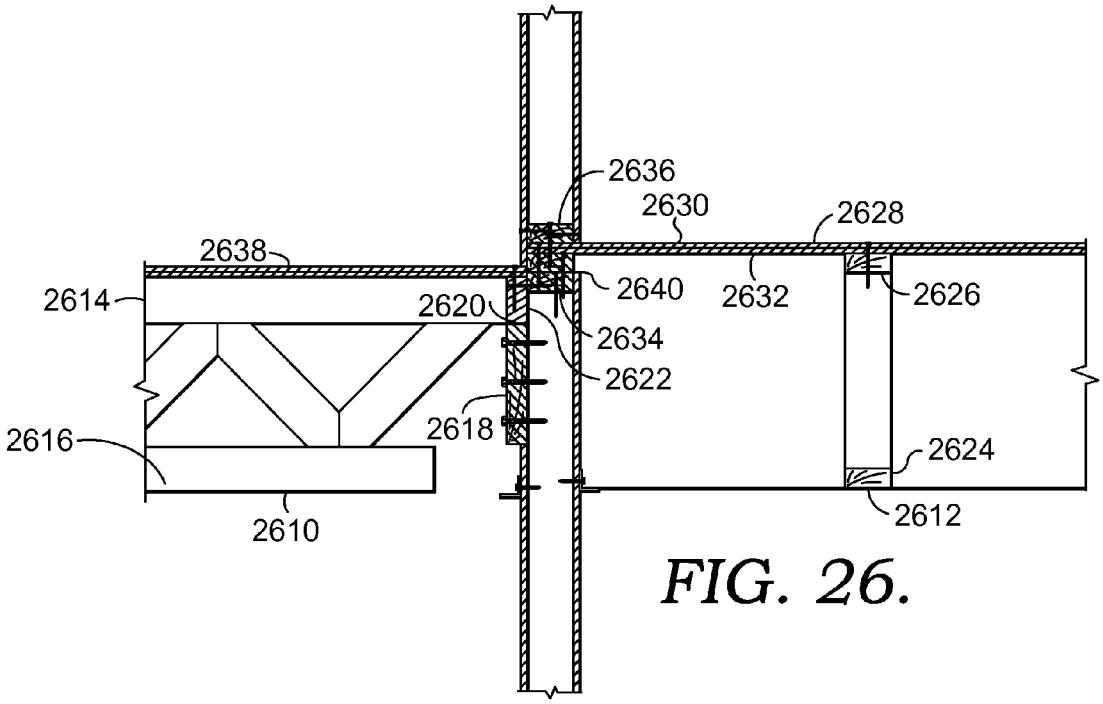
FIG. 26 is an exemplary view of a balcony interface between an exemplary hybrid top chord bearing floor truss and an exemplary wall, in accordance with an embodiment of the present invention.

FIG. 26 is an exemplary view of a balcony interface between an exemplary hybrid top chord bearing floor truss and an exemplary wall. Specifically, top chord bearing floor truss 2610 is illustrated in a load bearing orientation and top chord bearing floor truss 2612 is illustrated in a non-load bearing configuration. Top chord bearing floor truss 2610 includes a top chord 2614 and a bottom chord 2616. Top chord 2614 is supported by a ledger 2618. Specifically, the bottom surface 2620 of load bearing interface 2622 is supported by a top surface of ledger 2618. Likewise, top chord bearing floor truss 2612 includes a bottom chord 2624 and a top chord 2626. Floor sheathing 2628 is supported by the top chord 2626 of truss 2612. In addition, floor sheathing 2628 includes a top surface 2630 and a bottom surface 2632. Bottom surface 2632 of floor sheathing 2628 and bottom load bearing member 2636 of a second frame structure is supported by a floor sheathing 2638, member 2640 and top load bearing member 2634 of a first frame structure.

Figure 27:
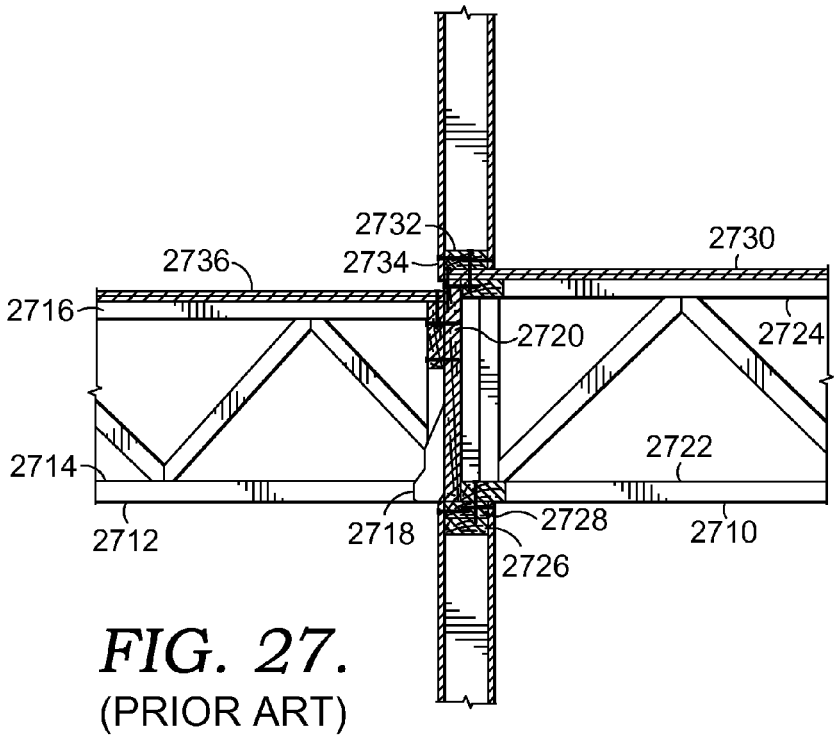
FIG. 27. (PRIOR ART)
FIG. 27 is an exemplary view of a balcony interface between a bottom chord bearing floor truss and an exemplary wall, the figure illustrates the prior art.

FIG. 27 is an exemplary view of a balcony interface between a bottom chord bearing floor truss and an exemplary wall. Specifically, bottom chord bearing floor truss 2710 and 2712 are illustrated in a load bearing orientation. Bottom load bearing floor truss 2712 includes a bottom chord 2714 and a top chord 2716. Bottom chord 2714 is supported by a hanger 2718 connected to rim board 2720. Bottom chord bearing floor truss 2710 includes a bottom chord 2722 and a top chord 2724. Rim board 2720 and bottom chord 2722 are supported by first top load bearing members 2726 associated with a first frame structure. This support forms a first connection point 2728. Floor sheathing 2730 is supported by top chord 2724, which further supports bottom load bearing member 2732 of a second frame structure. This forms a connection point 2734.

Figure 28:
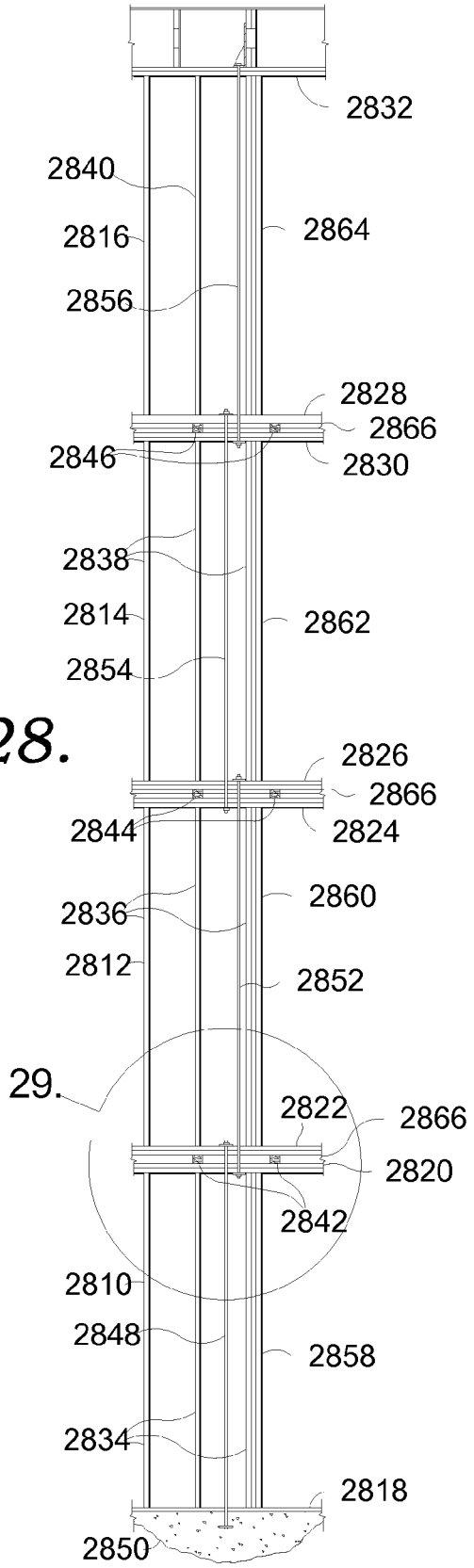
FIG. 28 is an exemplary view of a roof girder truss hold-down implemented along with an exemplary hybrid top chord bearing floor truss system, in accordance with an embodiment of the present invention.

FIG. 28 is an exemplary view of a roof G.T. hold down implemented along with an exemplary hybrid top chord bearing floor truss system. The figure illustrates a first frame assembly 2810 connected to a second frame assembly 2812, a third frame assembly 2814, and a fourth frame assembly 2816. Each assembly 2810, 2812, 2814, 2816 represents a level or story in a framed structure. Each frame assembly includes bottom plate and top plates. For example, first frame assembly 2810 includes a bottom plate 2818 and top plates 2820. Likewise a second frame assembly 2812 may include a bottom plate 2822 and top plates 2824. Similarly, third frame assembly 2814 and 2816 includes bottom plates 2826, 2828 and top plates 2830, 2832, respectively. Additionally, a plurality of studs 2858, 2860, 2862, 2864 are configured to transfer a load from the respective top plates to the respective bottom plates for each frame assembly. In a similar manner discussed above, top chord bearing floor trusses are implemented on each level and are illustrated as items 2842, 2844, 2846. Likewise, a fastener may be used to join the bottom plate to the top plates of the load bearing plates of the frame assembly below it.

In addition to all of the securing methods discussed above, threaded rods may be implemented to secure each level to one another. Specifically, threaded rod 2848 is shown extending from foundation 2850 up through bottom plate 2820 and top plates 2822 to secure first frame assembly 2810 to second frame assembly 2812 and foundation 2850. Likewise, rods 2852, 2854, 2856 may be implemented to secure the respective frame assemblies to one another.

Figure 29:
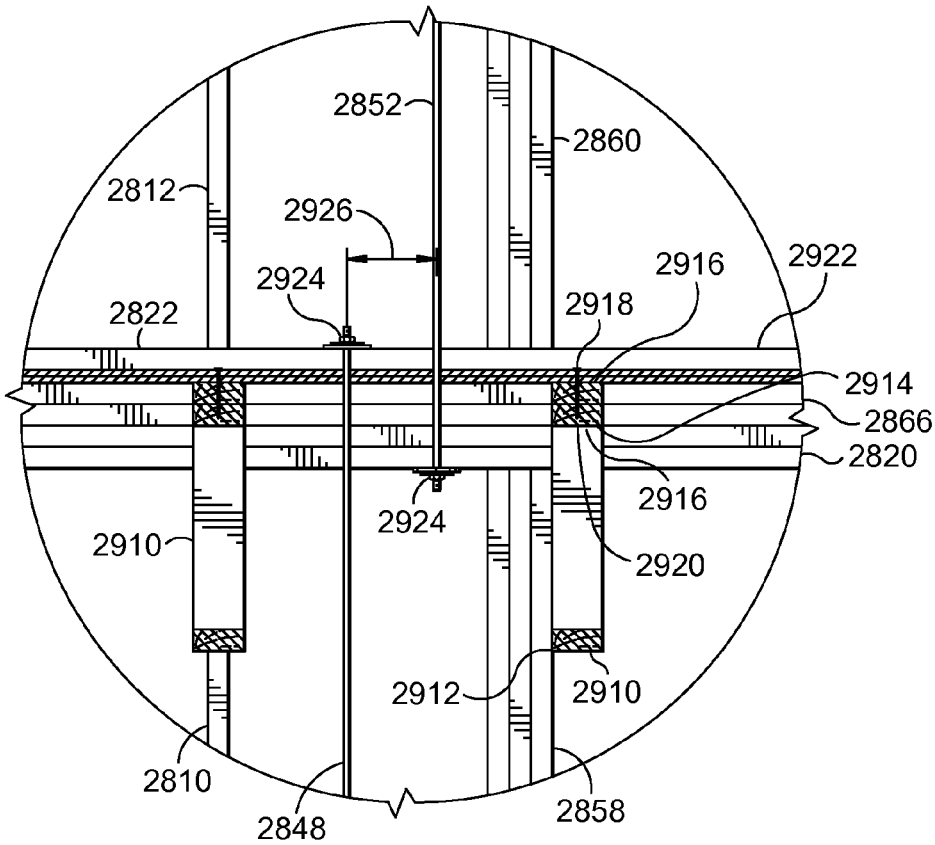
FIG. 29 is an enlargement of a roof girder truss hold-down illustrated in FIG. 28, in accordance with an embodiment of the present invention.

FIG. 29 is an enlargement of the roof G.T. hold-down illustrated in FIG. 28. The figure is a detailed view of securing the threaded rods to the respective levels. FIG. 29 is representative of connecting any of the levels to one another, even though it only illustrates the details for one level. Specifically, FIG. 29 illustrates a view of rods 2852 and 2848. As shown, top chord bearing floor truss 2910 is supported by top plates 2820 associated with a first assembly. In this embodiment, top plate 2820 includes two "2×4" plates parallel to one another. Top chord bearing floor truss includes a bottom chord 2912 and a top chord 2914. Top chord 2914 includes a load bearing surface 2916 and a load bearing interface having a top surface 2918 and a bottom surface 2920. Bottom plate 2822 is supported by top surface 2918, and bottom surface 2920 of top chord 2914 is supported by top plates 2820. In addition, floor sheathing 2922 may also be supported by top surface 2918 and by blocking 2866 between top chord bearing floor truss 2910.

In one embodiment, rod 2848 may include a five-eighths diameter threaded rod that is secured to the respective plates via nut 2924. Nut 2924 may be tightened or torqued so that it places rod 2848 in tension. This creates a pre-load that secures the second frame assembly to the first frame assembly. Likewise, rod 2852 may extend from bottom plate 2820 through top plates 2822 and up to and through top plates 2824 and bottom plate 2826, as illustrated in FIG. 28. Again, nut 2924 may be implemented on both ends of the rod to place rod 2852 in tension. Likewise, rods 2854 and 2856 may be implemented in similar fashion as illustrated in FIG. 29.

The center lines of rods 2848, 2854 may be offset from the center lines of rod 2856, 2852 by a distance, which FIG. 29 indicates as 2926. Distance 2926 may vary at each level, and in fact a rod may share the same center line with one rod, but be offset from another rod. In one embodiment in the present invention, distance 2926 is set at six inches maximum at each level to provide a concentrated load. For example, rods 2848 and 2854 may or may not lie on the same centerline, but the centerline for rods 2848 and 2852 is not greater than 6 inches in this embodiment.

Figure 30:
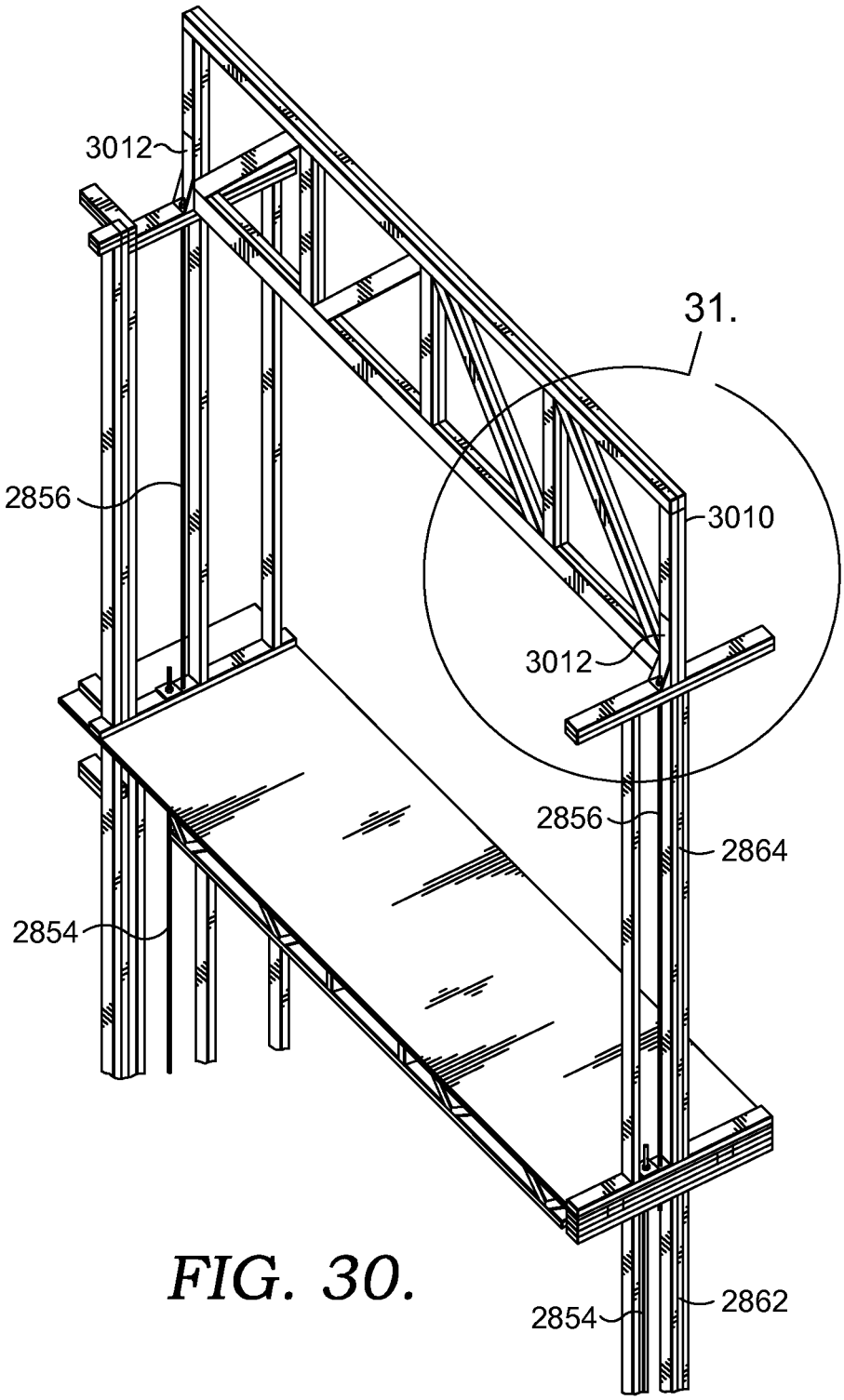
FIG. 30 is a perspective view of a roof girder truss hold-down illustrated in FIG. 28, in accordance with an embodiment of the present invention.

FIG. 30 is a perspective view of a roof G.T. hold-down illustrated in FIG. 28. The figure specifically illustrates a view of third frame assembly 2814 and fourth assembly 2816. Rod 2854 joins the respective frame assemblies together. In addition, rod 2856 connects the assemblies to girder truss ("G.T.") 3010 via connector 3012. Pluralities of studs 2864 are required under the roof G.T. One skilled in the art will recognize that a girder truss is typically a multi-plied truss designed to carry other trusses over an opening.

Figure 31:
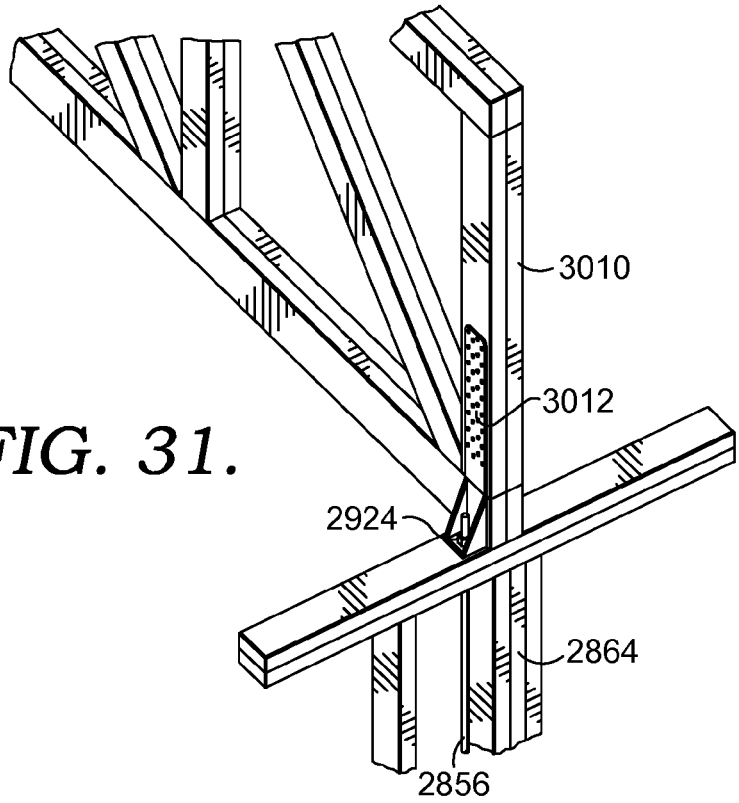
FIG. 31 is an enlargement of a roof girder truss hold-down illustrated in FIG. 30, in accordance with an embodiment of the present invention.

FIG. 31 is an enlargement of the roof G.T. hold-down illustrated in FIG. 30. Girder truss 3010 may include bracket 3012 that provides a location to secure rod 2856 to girder truss 3010. In one embodiment, nut 2924 is used to connect rod 2856 to bracket 3012. As before, nut 2924 may be used to place rod 2856 in tension and further secure girder truss 3010 to the fourth frame assembly.

Figure 32:
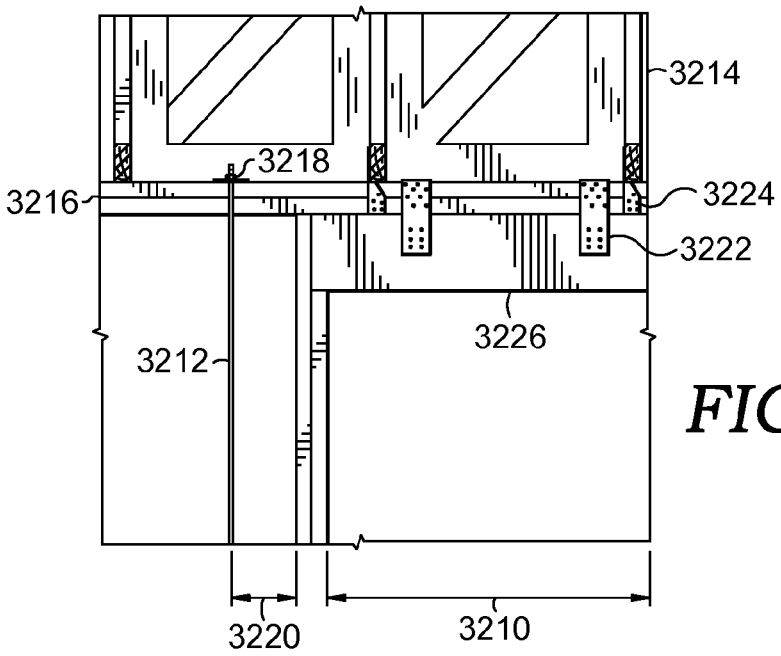
FIG. 32 is an exemplary view of a roof beam uplift detail, in accordance with an embodiment of the present invention.

FIG. 32 is an exemplary view of a roof beam uplift detail. The figure illustrates an embodiment of the present invention used at a door or window opening 3210. It is not uncommon for window or door opening 3210 to be wider than four feet across. One skilled in the art will recognize that such an opening can compromise the strength of the structure against uplift forces. Thus, rod 3212 may be implemented to further secure and resist the uplift forces placed on the frame assembly. Again, rod 3212 may extend through top plates 3216 and be secured via nut 3218. Roof truss 3214 may be connected to top plate 3216 with clip 3224. Top plates 3216 may be connected to the beam 3226 over the opening with clip 3222. In one embodiment of the present invention, rod 3218 is located within a distance 3220 from the edge of the opening 3210. In this embodiment, this distance is not greater than six inches.

Figure 33:
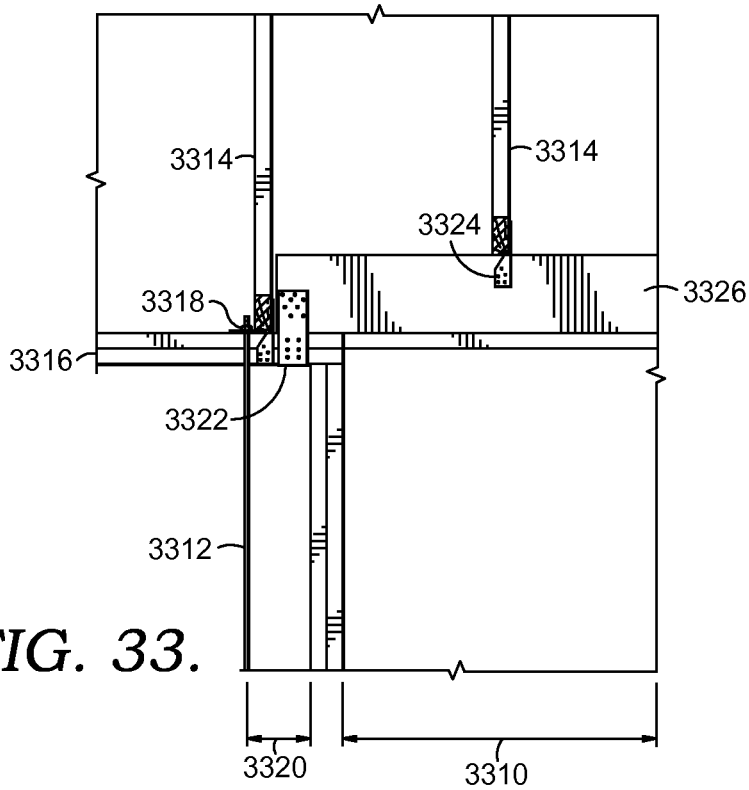
FIG. 33 is an exemplary view of a roof flush beam uplift detail, in accordance with an embodiment of the present invention.

FIG. 33 is an exemplary view of a roof flush beam uplift detail. The figure illustrates a similar configuration to FIG. 32 in that an opening 3310 is included for a window or a door. Again, this opening may be greater than four feet wide reducing the structural integrity of its uplift forces. Thus, rod 3312 may be implemented to connect the frame assembly. Rod 3312 extends through top plates 3316 and can be secured via nut 3318. Roof trusses 3314 may be connected to the beam 3326 with clip 3324. Beam 3326 may be connected to top plates 3316 with clip 3322. In addition, rod 3312 may be located within a distance 3320 of opening 3310. In one embodiment of the present invention, distance 3320 is not greater than six inches.

Figure 34:
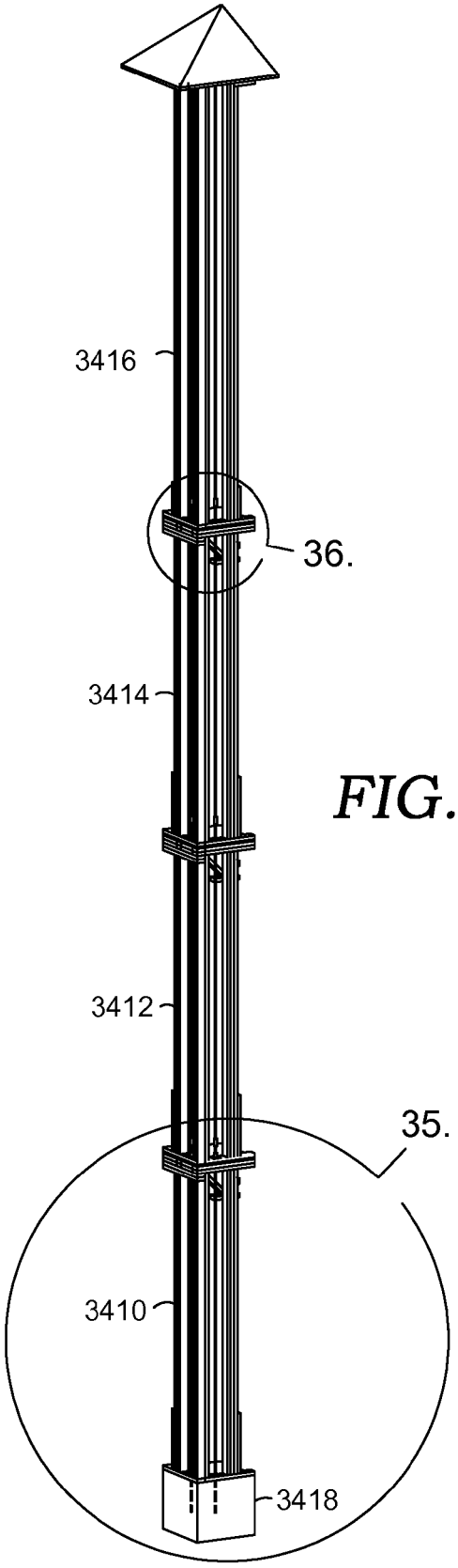
FIG. 34 is a perspective view of a shear wall end anchorage elevation implemented in an exemplary hybrid top chord bearing floor truss system, in accordance with an embodiment of the present invention.

FIG. 34 is a perspective view of shear wall end anchorage elevation implemented in an exemplary hybrid top chord bearing floor truss system. Specifically, FIG. 34 illustrates a first frame assembly 3410, a second frame assembly 3412, a third frame assembly 3414, and a fourth frame assembly 3416. The first frame assembly 3410 is supported by foundation 3418. Each frame assembly includes a bottom plate and top plates with the top plates used to support a top chord load bearing floor truss.

Figure 35:
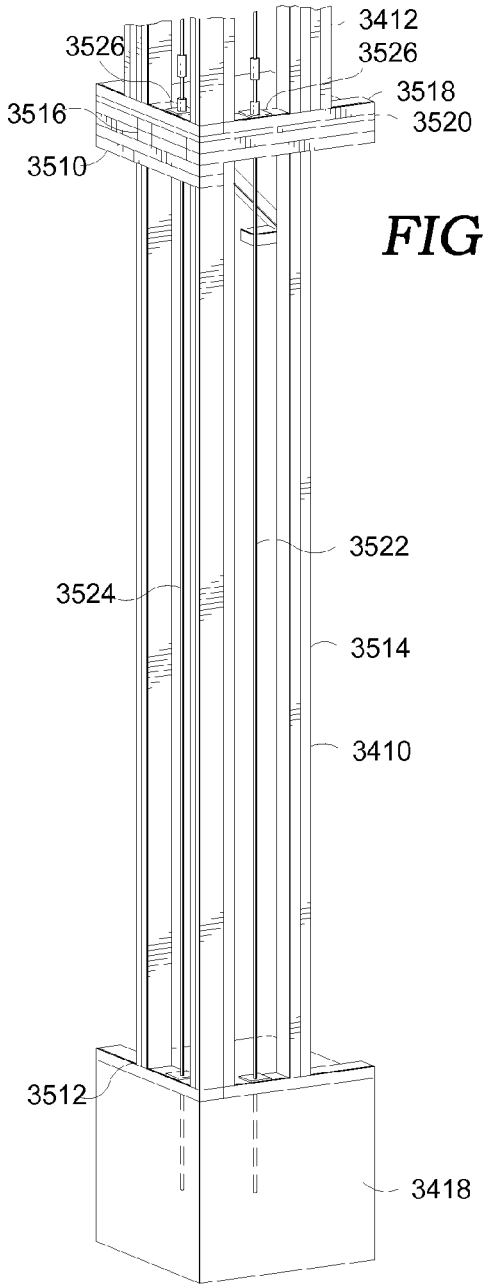
FIG. 35 is an enlargement of a shear wall end anchorage elevation illustrated in FIG. 34, in accordance with an embodiment of the present invention.

FIG. 35 is an enlargement of the shear wall end anchorage elevation illustrated in FIG. 34. The figure illustrates first frame assembly with top plates 3510, bottom plate 3512, and a plurality of studs configured to transfer a load from first top plates 3510 to bottom plate 3512. Again, top plates 3510 is configured to support top chord load bearing floor truss 3516. FIG. 35 also illustrates bottom load plate 3518 of second frame assembly 3412 along with a floor sheathing 3520. In this embodiment, rod 3522 and rod 3524 are used to secure the second frame assembly 3412 to first frame assembly 3514 and foundation 3418. Specifically, rods 3522, 3524 extend up from foundation 3418 through bottom plate 3512 up through top plate 3510 and through bottom plate 3518. Bottom plate 3518 may include a self-locking mechanism 3526. Self-locking mechanism 3526 may be attached to bottom plate 3518 with fasteners. The self-locking mechanism may be configured to allow threaded rods 3522, 3524 to pass through the mechanism in one direction but lock when rods 3522, 3524 are loaded in the opposite direction.

Figure 36:
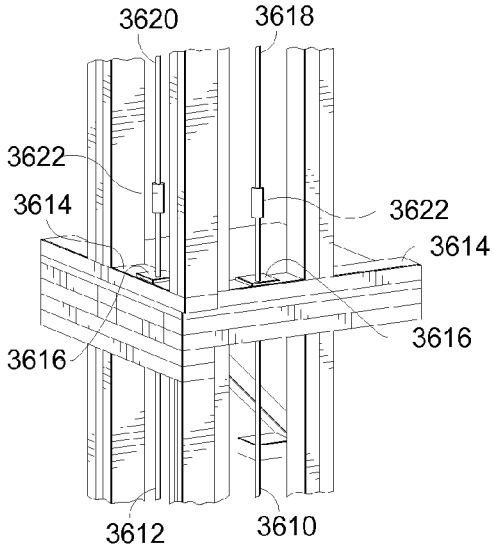
FIG. 36 is an enlargement of a shear wall end anchorage elevation illustrated in FIG. 34, in accordance with an embodiment of the present invention.

FIG. 36 is an enlargement of the shear wall end anchorage elevation illustrated in FIG. 34. The figure illustrates threaded rods 3610, 3612 extending through the bottom plates 3614 and self-locking mechanism 3616. Threaded rods 3610, 3612 are then connected to threaded rods 3618, 3620 via a coupler 3622. Coupler 3622 and self-locking mechanism 3616 allow tensioning of each level independently. This is because self-locking mechanism 3616 can provide for threaded rod 3610 and 3612 to pass through in one direction and provide resistance when the rod is loaded in the opposite direction. In addition, implementing the hybrid top chord bearing floor framing system provides for a reduced number of plates that threaded rods 3610, 3612, 3618, and 3620 have to pass through to engage coupler 3622. Thus, embodiments of the present invention provide a reduced number of chords or plates that have to be drilled out and aligned. Additionally, embodiments of the present invention reduce the distance between the plates simplifying installation. One skilled in the art would appreciate that this simplification provides a compact load path.

Figure 37:
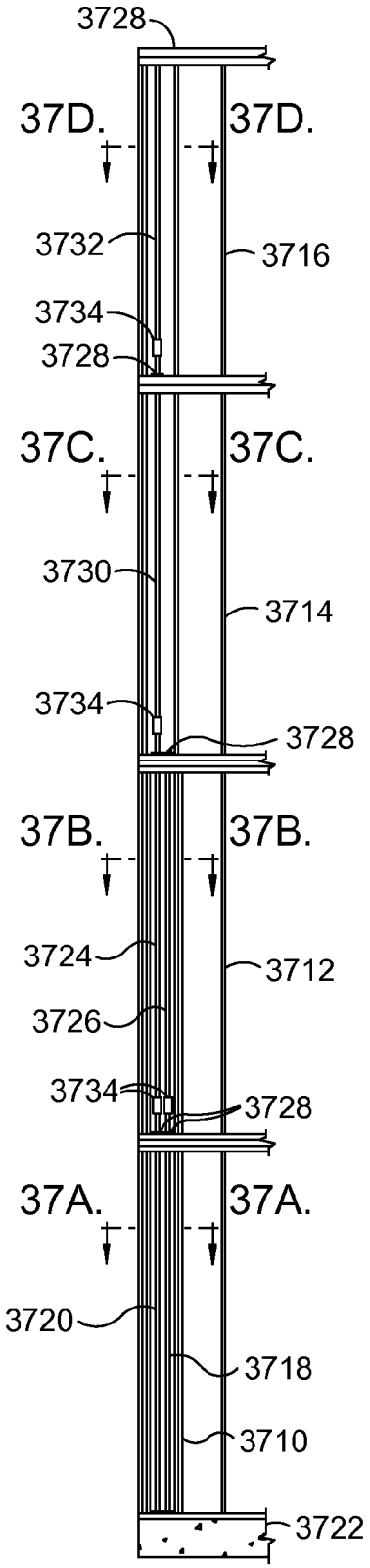
FIG. 37 is a front view of a first embodiment of a shear wall end anchorage elevation implemented in an exemplary hybrid top chord bearing floor truss system, in accordance with an embodiment of the present invention.

FIG. 37 is a front view of a first embodiment of a shear wall end anchorage elevation implemented in an exemplary hybrid top chord bearing floor truss system. The figure illustrates a multilevel structure including at least four frame assemblies or levels. Specifically, first frame assembly 3710 is secured to second frame assembly 3712, which is further secured to third frame assembly 3714 and fourth frame assembly 3716. In this embodiment, multiple rods are used on the first two levels. Specifically rods 3718 and 3720 are used to secure first frame assembly 3710 and second frame assembly 3712 to foundation 3722. Likewise, rods 3724 and 3726 are used to secure second frame assembly 3712 and third frame assembly 3714 to foundation 3722. Couplers 3734 are used to connect the rods from one level to the rods on the next level. Again, a self-locking mechanism 3728 is fastened to the bottom plate at each assembly level to provide a one-way locking mechanism for each of the threaded rods. In addition, FIG. 37 illustrates that a single rod 3730 and 3732 is implemented for the third frame and fourth frame assembly. As before couplers 3734 may be implemented at each level to connect the rod from the previous level to the next level. In one embodiment of the present invention, the rods implemented are half-inch diameter threaded rods.

FIG. 37A-37D are cross-sectional views of a shear wall end anchorage elevation when viewed from the appropriate perspectives of FIG. 37. Specifically, the figures illustrate the compression posts, which maybe made of multiple studs, at each level. Two compression posts 3736, 3738 are used at the first level. The compression posts are separated by a distance 3740, and threaded rods 3720, 3718 are positioned between the two compression posts. In one embodiment of the present invention, distance 3740 is not greater than 8 inches. The cross section for compression posts 3738 may include three 2×4 studs, with each stud having the dimensions of 3½ inches wide by 1½ inches tall. Similarly, compression post 3736 may include two 2×4 studs, with each stud having the dimensions of 3½ inches wide by 1½ inches tall.

Figure 37D:
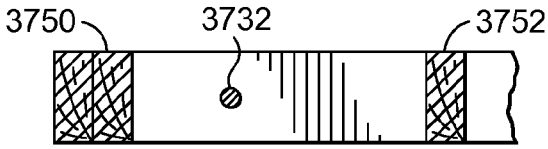
FIG. 37A-37D are cross-sectional views of a shear wall end anchorage elevation when viewed from the appropriate perspectives of FIG. 37, in accordance with an embodiment of the present invention.
Figure 37C:
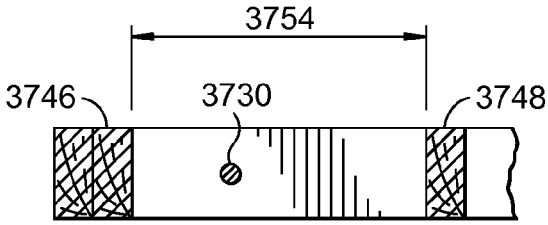
Figure 37B:
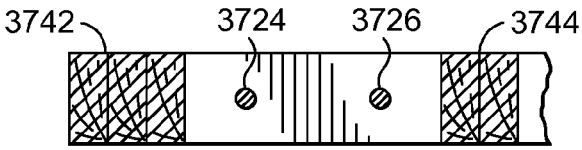
Figure 37A:
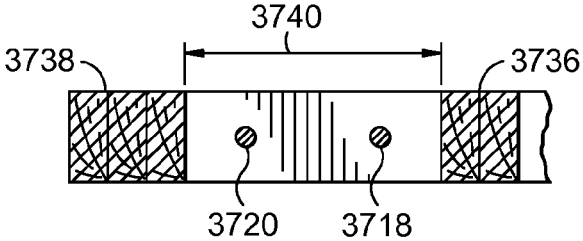

Like the first level, the second frame assembly includes a first compression posts 3742 and a second compression posts 3744 as illustrated by FIG. 37B. These posts are separated by distance 3740 and rods 3724 and 3726 are positioned between the posts. Likewise, FIG. 37C illustrates compression posts for the third level. This level includes first compression posts 3746 and second compression posts 3748. Again these posts may be separated by a distance 3754 and rod 3730 is positioned between the posts. FIG. 37D illustrates compression posts for the fourth level. This level includes first posts 3750 and second posts 3752. Again, these posts may be separated by a distance 3754 and rod 3732 is positioned between the posts. All of these posts are sized to provide the necessary support for the pre-load placed on each level by tensioning the rods.

Figure 38:
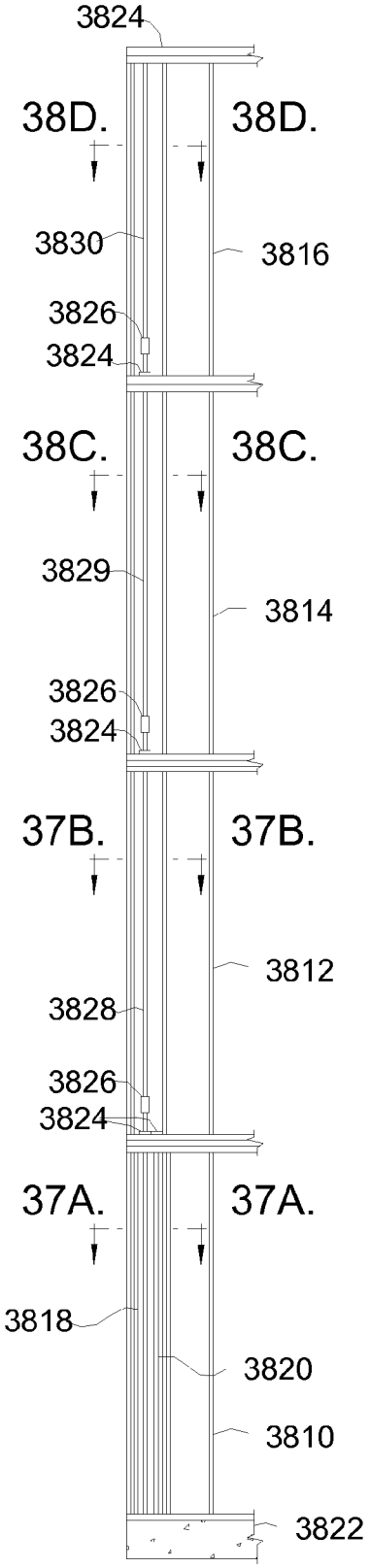
FIG. 38 is a front view of a second embodiment of a shear wall end anchorage elevation implemented in an exemplary hybrid top chord bearing floor truss system, in accordance with an embodiment of the present invention.

FIG. 38 is a front view of a second embodiment of a shear wall end anchorage elevation implemented in an exemplary hybrid top chord bearing floor truss system. The figure illustrates a multilevel structure including at least four frame assemblies or levels. Specifically, first frame assembly 3810 is secured to second frame assembly 3812, which is further secured to third frame assembly 3814 and fourth frame assembly 3816. In this embodiment, multiple rods are used only on the first level. Specifically rods 3818 and 3820 are used to secure first frame assembly 3810 and second frame assembly 3812 to foundation 3822. Couplers 3826 are used to connect the rods from one level to the rods on the next level. Again, a self-locking mechanism 3824 is fastened to the bottom plate at each assembly level to provide a one-way locking mechanism for each of the threaded rods. In addition, FIG. 38 illustrates that a single rod 3828, 3829, 3830 is implemented for the second, third, and fourth frame assembly. As before, couplers 3826 may be implemented at each level to connect the rod from the previous level to the next level. In one embodiment of the present invention, the rods implemented are half-inch diameter threaded rods.

FIG. 38A-38D are cross-sectional views of a shear wall end anchorage elevation when viewed from the appropriate perspectives of FIG. 38. Specifically, the figures illustrate the compression studs at each level. Two compression posts 3832, 3834 are used at the first level. The compression posts are separated by a distance 3836, and threaded rods 3818, 3820 are positioned between the two compression posts. In one embodiment of the present invention, distance 3836 is not greater than 8 inches. The cross section for compression posts 3832 may include three 2×4 studs, with each stud having the dimensions of 3½ inches wide by 1½ inches tall. Similarly, compression posts 3834 may include two 2×4 studs, with each stud having the dimensions of 3½ inches wide by 1½ inches tall.

Figure 38D:
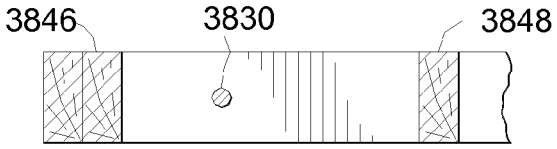
FIG. 38A-38D are cross-sectional views of a shear wall end anchorage elevation when viewed from the appropriate perspectives of FIG. 38, in accordance with an embodiment of the present invention.
Figure 38C:
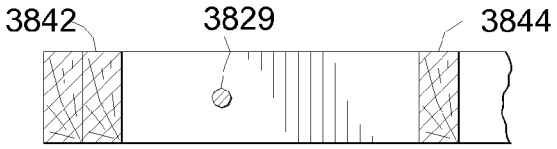
Figure 38B:
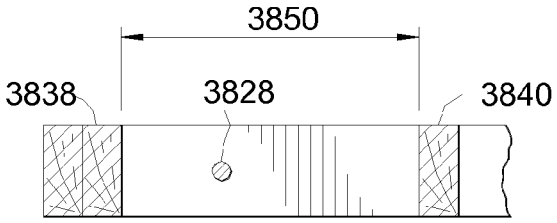
Figure 38A:
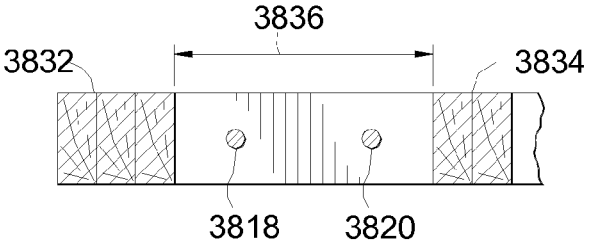

Like the first level, the second frame assembly includes a first compression posts 3838 and a second compression posts 3840 as illustrated by FIG. 38B. These studs are separated by distance 3850 and rod 3828 is positioned between the posts. Likewise, FIG. 38C illustrates compression posts for the third level. This level includes first posts 3842 and second posts 3844. Again, these posts may be separated by a distance 3850 and rod 3829 is positioned between the posts. FIG. 38D illustrates compression studs for the fourth level. This level includes first posts 3846 and second posts 3848. Again, these posts may be separated by a distance 3850 and rod 3830 may be positioned between the posts. All of these posts are sized to provide the necessary support for the pre-load placed on each level by tensioning the rods.

Figure 39:
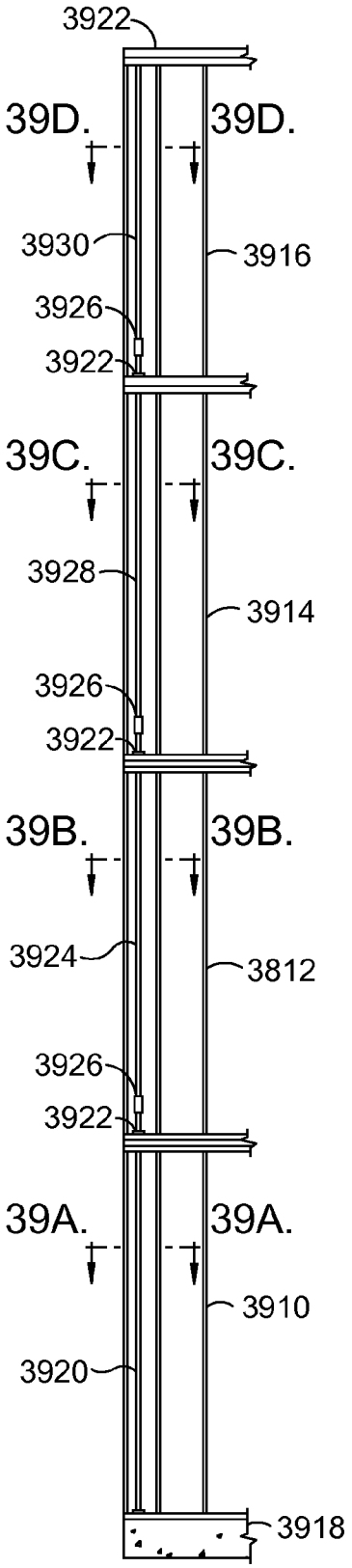
FIG. 39 is a front view of a third embodiment of a shear wall end anchorage elevation implemented in an exemplary hybrid top chord bearing floor truss system, in accordance with an embodiment of the present invention.

FIG. 39 is a front view of a third embodiment of a shear wall end anchorage elevation implemented in an exemplary hybrid top chord bearing floor truss system. The figure illustrates a multilevel structure including at least four frame assemblies or levels. Specifically, first frame assembly 3910 is secured to second frame assembly 3912, which is further secured to third frame assembly 3914 and fourth frame assembly 3916. In this embodiment, only a single rod is used on each level. Specifically, rod 3920 is used to secure first frame assembly 3910 and second frame assembly 3912 to foundation 3918. Couplers 3926 are used to connect the rods from one level to the rods on the next level. Again, self-locking mechanism 3922 is fastened to the bottom plate at each assembly level to provide a one-way locking mechanism for each of the threaded rods. In addition, FIG. 39 illustrates that single rod 3924, 3928, 3930 is implemented for the second, third, and fourth frame assembly. As before, couplers 3926 may be implemented at each level to connect the rod from the previous level to the next level. In one embodiment of the present invention, the rods implemented are half-inch diameter threaded rods.

FIG. 39A-39D are cross-sectional views of a shear wall end anchorage elevation when viewed from the appropriate perspectives of FIG. 39. Specifically, the figures illustrate the compression posts at each level. Two compression posts 3932, 3934 are used at the first level. The compression posts are separated by a distance 3936, and threaded rod 3920 is positioned between the two compression posts. In one embodiment of the present invention, distance 3936 is not greater than 8 inches. The cross section for compression post 3932 may include a 2×4 stud, with the stud having the dimensions of 3½ inches wide by 1½ inches tall. Similarly, compression post 3934 may include a 2×4 stud, with the stud having the dimensions of 3½ inches wide by 1½ inches tall.

Figure 39D:
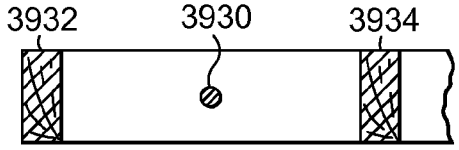
FIGS. 39A-39D are cross-sectional views of a shear wall end anchorage elevation when viewed from the appropriate perspectives of FIG. 38, in accordance with an embodiment of the present invention.
Figure 39C:
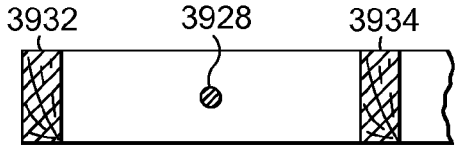
Figure 39B:
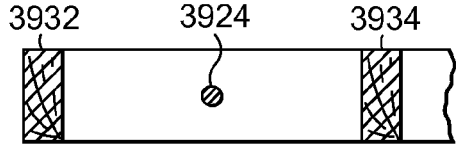
Figure 39A:
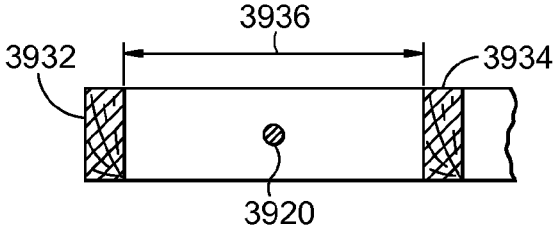

Like the first level, the second frame assembly includes a first compression posts 3932 and a second compression posts 3934 as illustrated by FIG. 39B. These posts are separated by distance 3936 and rod 3924 is positioned between the posts. Likewise, FIG. 39C illustrates compression posts for the third level. This level includes first post 3932 and second post 3934. Again, these posts may be separated by a distance 3936 and rod 3928 is positioned between the posts. FIG. 39D illustrates compression posts for the fourth level. This level includes first post 3932 and second post 3934. Again, these posts may be separated by a distance 3936 and rod 3930 may be positioned between the posts. All of these posts are sized to provide the necessary support for the pre-load placed on each level by tensioning the rods.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims

The invention claimed is:

1. A method for securing a multilevel structure, the method comprising:

positioning a first frame assembly such that a bottom plate is supported by a foundation structure and a top plate is oriented to support a truss, wherein said first frame assembly includes a plurality of studs configured to transfer a load from said top plate to said bottom plate;

positioning said truss on said top plate such that a top chord of said truss is wholly supported by said top plate, wherein said top chord includes a top surface, a bottom surface, a bottom chord, and a plurality of webs extending between said top surface and said bottom chord, where said bottom chord terminates between said first frame assembly and an attachment of a web to said bottom chord that is most proximal to said first frame assembly;

positioning a second frame assembly such that a bottom plate of said second frame assembly is supported by said top surface of said truss, wherein said second frame assembly includes a plurality of studs configured to transfer a load from a top plate of said second frame structure to said bottom plate of said second frame assembly;

securing said second frame assembly to said foundation structure and said first frame assembly via a first threaded rod secured to and extending from said foundation structure through said bottom plate of said first frame assembly, said top plate of said first frame assembly, and said bottom plate of said second frame assembly; and securing said second frame assembly to said first frame assembly via a second threaded rod connecting said top plate of said first frame assembly to said top plate of said second frame assembly.

2. The method of claim 1, further comprising placing said first threaded rod in tension to secure said second frame assembly to said foundation structure and said first frame assembly, and placing said second threaded rod in tension to further secure said second frame structure to said first frame structure.

3. The method of claim 1, further comprising positioning a floor sheathing and a blocking between said bottom plate of said second assembly and said top chord of said truss.

4. The method of claim 1, wherein a centerline of said first threaded rod is offset from a centerline of said second threaded rod by a distance that is not greater than 6 inches.

5. The method of claim 1, further comprising, positioning at least one additional frame assembly such that a bottom plate of said additional frame assembly is supported by said top plate of said second frame assembly, wherein said additional frame assembly includes a plurality of studs configured to transfer a load from a top plate of said additional frame assembly to said bottom plate of said additional frame assembly;

positioning a girder truss on said top plate of said additional frame assembly, wherein said girder truss includes a connector;

securing said additional frame assembly and said girder truss to said second frame assembly via a third threaded rod extending through said top plate of said second frame assembly, said bottom plate of said additional frame assembly, said top plate of said additional frame assembly, and said connector of said girder truss; and placing said third threaded rod in tension to further secure said additional frame assembly to said second frame assembly.

6. The method of claim 5, wherein a centerline of said first rod is offset from a centerline of said second rod by a distance that is not greater than 6 inches, and a said centerline of said second rod is offset from a centerline of said third rod by a distance that is not greater than 6 inches.

7. The method of claim 5, further comprising threading a nut onto each of said first, second, and third threaded rods to place said rods in tension, wherein said rods extend at least 1 inch above said nut.

8. The method of claim 1, wherein at least one of said frame assemblies includes at least one location where the distance between adjacent studs is greater than four feet.

9. The method of claim 1, further comprising, adding a first and a second self-locking mechanism to said bottom plate of said second frame assembly;

adding a third self-locking mechanism to said top plate of said second frame assembly;

securing and extending a third threaded rod from said foundation through said bottom plate of said second frame assembly;

positioning said first threaded rod to engage and project above said first self-locking mechanism;

positioning said third rod to engage said second self-locking mechanism, whereby said engagement of said first and said third threaded rods secure said second frame assembly and said first frame assembly to said foundation member;

attaching a coupler to said first threaded rod and connecting said second threaded rod to said first threaded rod; and positioning said second threaded rod to engage said third self-locking mechanism, whereby said engagement of said second threaded rod secures said second frame assembly and said first frame assembly to said foundation member.

10. The method of claim 9, wherein said first and said third threaded rods are positioned in between a first and a second compression post, wherein said first compression post includes a cross-section having dimensions of at least 3.5 inches wide by 1.5 inches high and said second compression post includes a cross-section having dimensions of at least 3.5 inches wide by 1.5 inches high, and said first and second compression posts are separated by a distance that is not greater than 8 inches.

* * * * *